US008131204B2

(12) United States Patent
Kadota

(10) Patent No.: US 8,131,204 B2
(45) Date of Patent: Mar. 6, 2012

(54) IMAGE FORMING APPARATUS, PROGRAM FOR IMAGE FORMING APPARATUS, AND DRIVER PROGRAM FOR IMAGE FORMING APPARATUS

(75) Inventor: Masatoshi Kadota, Takahama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 992 days.

(21) Appl. No.: 11/882,165

(22) Filed: Jul. 31, 2007

(65) Prior Publication Data

US 2008/0025740 A1 Jan. 31, 2008

(30) Foreign Application Priority Data

Jul. 31, 2006 (JP) ..... 2006-208569

(51) Int. Cl.
*G03G 15/00* (2006.01)

(52) U.S. Cl. ..... 399/401; 399/364

(58) Field of Classification Search ..... 399/405, 399/45

See application file for complete search history.

(56) References Cited

U.S. PATENT DOCUMENTS

| | | | |
|---|---|---|---|
| 5,596,399 | A | 1/1997 | Dempsey et al. |
| 5,731,879 | A | 3/1998 | Maniwa et al. |
| 5,854,965 | A | 12/1998 | Kasiwabara et al. |
| 6,275,676 | B1 | 8/2001 | Ushio |
| 7,466,957 | B2 | 12/2008 | Muto |
| 2003/0161671 | A1 | 8/2003 | Hokiyama |
| 2003/0231914 | A1* | 12/2003 | Yasui ..... 399/396 |
| 2005/0286088 | A1* | 12/2005 | Takagi ..... 358/3.28 |

FOREIGN PATENT DOCUMENTS

| | | | |
|---|---|---|---|
| JP | 07-129057 | | 5/1995 |
| JP | 8-81121 | | 3/1996 |
| JP | 8-278728 | A | 10/1996 |
| JP | 09202008 | A * | 8/1997 |
| JP | 11-030886 | | 2/1999 |
| JP | 2003-276285 | | 9/2003 |
| JP | 2004-322397 | | 11/2004 |
| JP | 2006-110802 | | 4/2006 |
| JP | 2006088684 | A * | 4/2006 |

OTHER PUBLICATIONS

Japanese Office Action issued in Japanese Patent Application No. JP 2006-208569, mailed Feb. 10, 2009.

Japanese Notification of Reasons for Refusal, w/ English translation thereof, issued in Japanese Patent Application No. 2006-208596 dated on Aug. 19, 2008.

* cited by examiner

*Primary Examiner* — Daniel J Colilla
*Assistant Examiner* — Allister Primo
(74) *Attorney, Agent, or Firm* — Baker Botts L.L.P.

(57) ABSTRACT

An image forming apparatus includes a single-sided image forming unit that forms an image on a first side of a sheet and discharges the sheet in a predetermined discharge state, a first double-sided image forming unit that forms an image of an even page on a first side of the sheet, reverses the sheet on which the even page is formed, conveys the reversed sheet to an image forming unit, forms an image of an odd page on a second side of the sheet, and discharges the sheet in a predetermined discharge state, and a second double-sided image forming unit that forms an image of an even page on the second side of the sheet and an image of an odd page on the first side of the sheet and discharges the sheet in a predetermined discharge state.

15 Claims, 12 Drawing Sheets

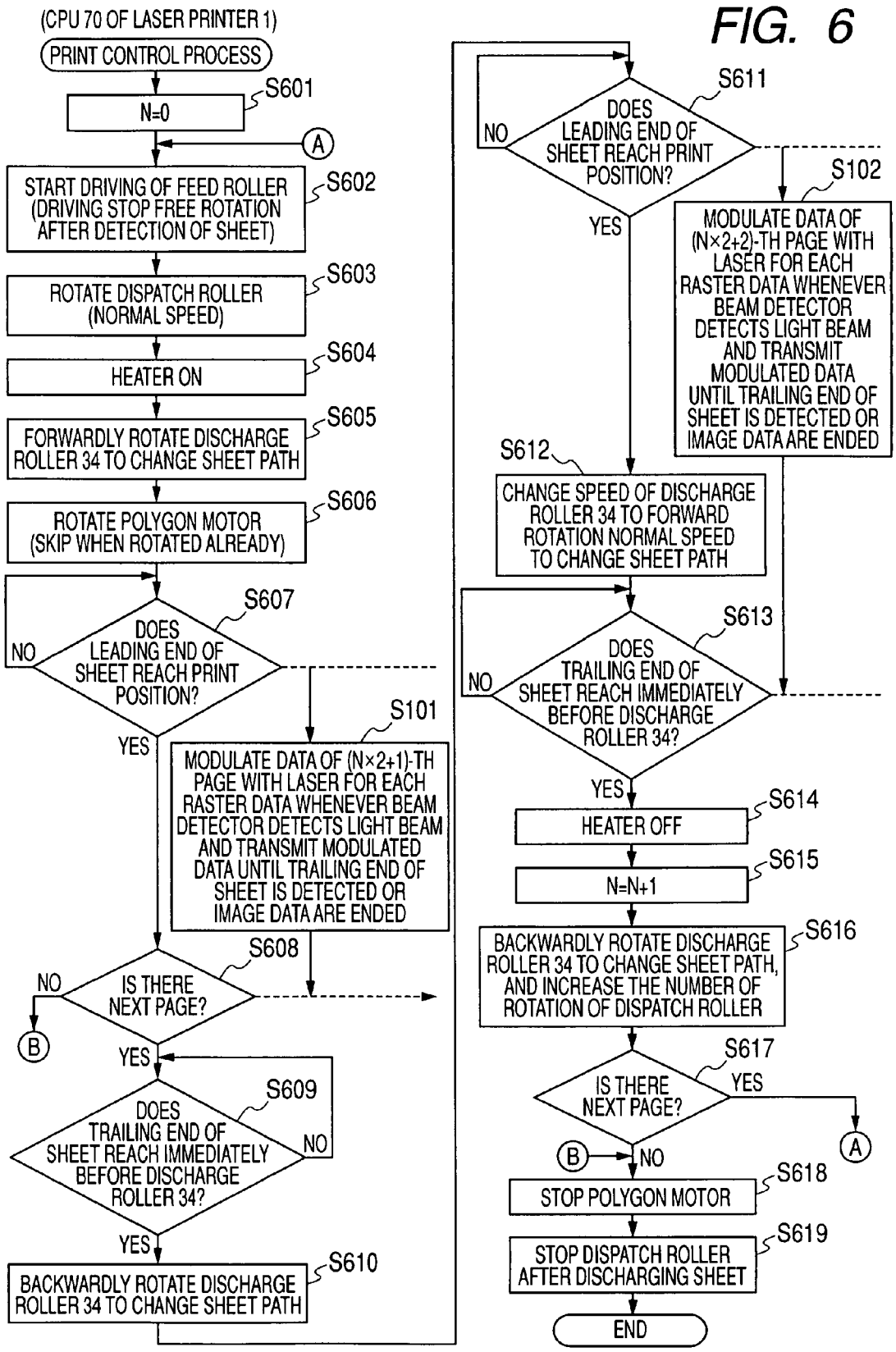
FIG. 6
(CPU 70 OF LASER PRINTER 1)
PRINT CONTROL PROCESS
S601
N=0
A
S602
START DRIVING OF FEED ROLLER (DRIVING STOP FREE ROTATION AFTER DETECTION OF SHEET)
S603
ROTATE DISPATCH ROLLER (NORMAL SPEED)
S604
HEATER ON
S605
FORWARDLY ROTATE DISCHARGE ROLLER 34 TO CHANGE SHEET PATH
S606
ROTATE POLYGON MOTOR (SKIP WHEN ROTATED ALREADY)
S607
DOES LEADING END OF SHEET REACH PRINT POSITION?
NO
YES
S101
MODULATE DATA OF (N×2+1)-TH PAGE WITH LASER FOR EACH RASTER DATA WHENEVER BEAM DETECTOR DETECTS LIGHT BEAM AND TRANSMIT MODULATED DATA UNTIL TRAILING END OF SHEET IS DETECTED OR IMAGE DATA ARE ENDED
S608
IS THERE NEXT PAGE?
NO
B
YES
S609
DOES TRAILING END OF SHEET REACH IMMEDIATELY BEFORE DISCHARGE ROLLER 34?
NO
YES
S610
BACKWARDLY ROTATE DISCHARGE ROLLER 34 TO CHANGE SHEET PATH
S611
DOES LEADING END OF SHEET REACH PRINT POSITION?
NO
YES
S102
MODULATE DATA OF (N×2+2)-TH PAGE WITH LASER FOR EACH RASTER DATA WHENEVER BEAM DETECTOR DETECTS LIGHT BEAM AND TRANSMIT MODULATED DATA UNTIL TRAILING END OF SHEET IS DETECTED OR IMAGE DATA ARE ENDED
S612
CHANGE SPEED OF DISCHARGE ROLLER 34 TO FORWARD ROTATION NORMAL SPEED TO CHANGE SHEET PATH
S613
DOES TRAILING END OF SHEET REACH IMMEDIATELY BEFORE DISCHARGE ROLLER 34?
NO
YES
S614
HEATER OFF
S615
N=N+1
S616
BACKWARDLY ROTATE DISCHARGE ROLLER 34 TO CHANGE SHEET PATH, AND INCREASE THE NUMBER OF ROTATION OF DISPATCH ROLLER
S617
IS THERE NEXT PAGE?
YES
A
B
NO
S618
STOP POLYGON MOTOR
S619
STOP DISPATCH ROLLER AFTER DISCHARGING SHEET
END (FIG. 8 CONTINUED)
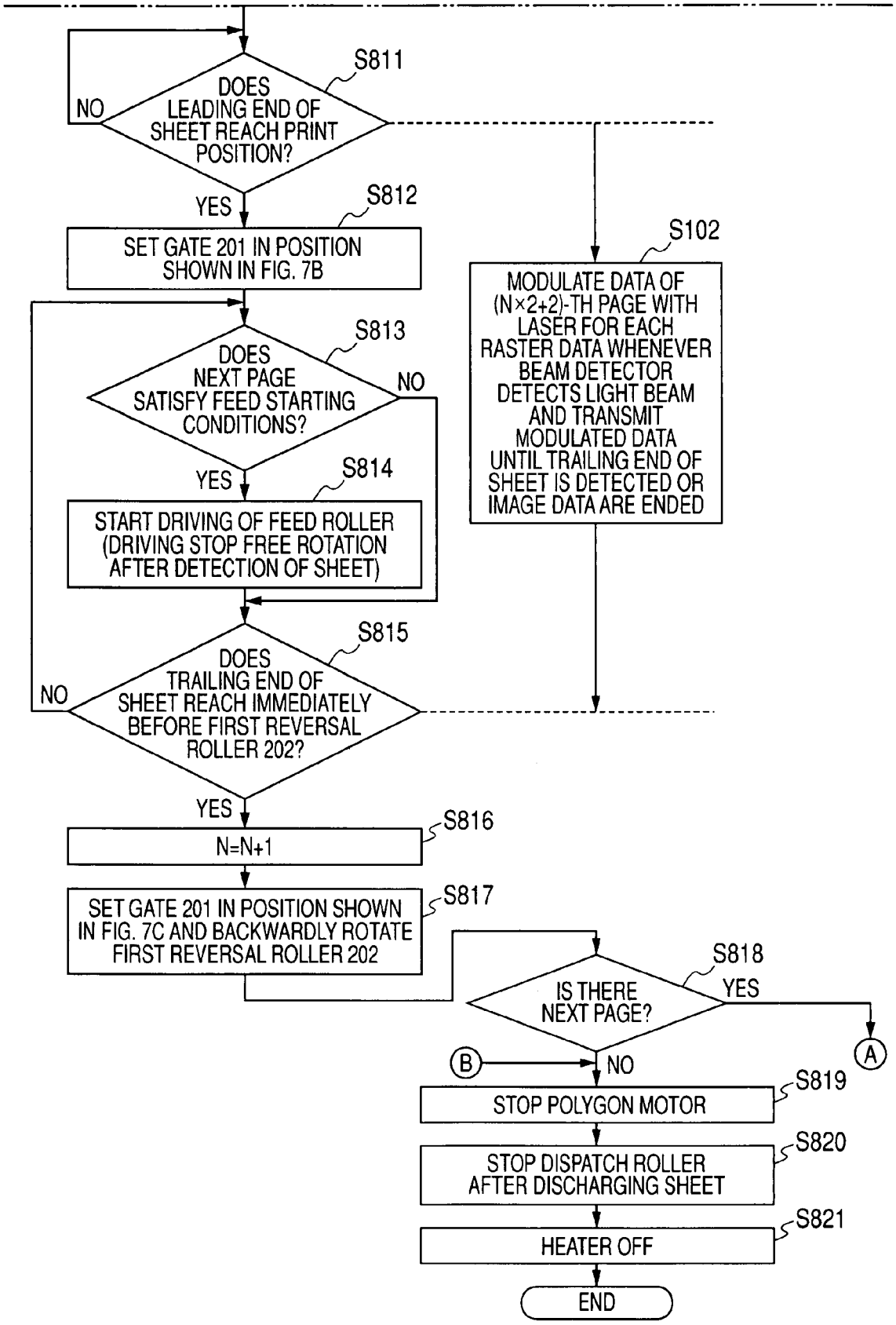

(FIG. 10 CONTINUED)
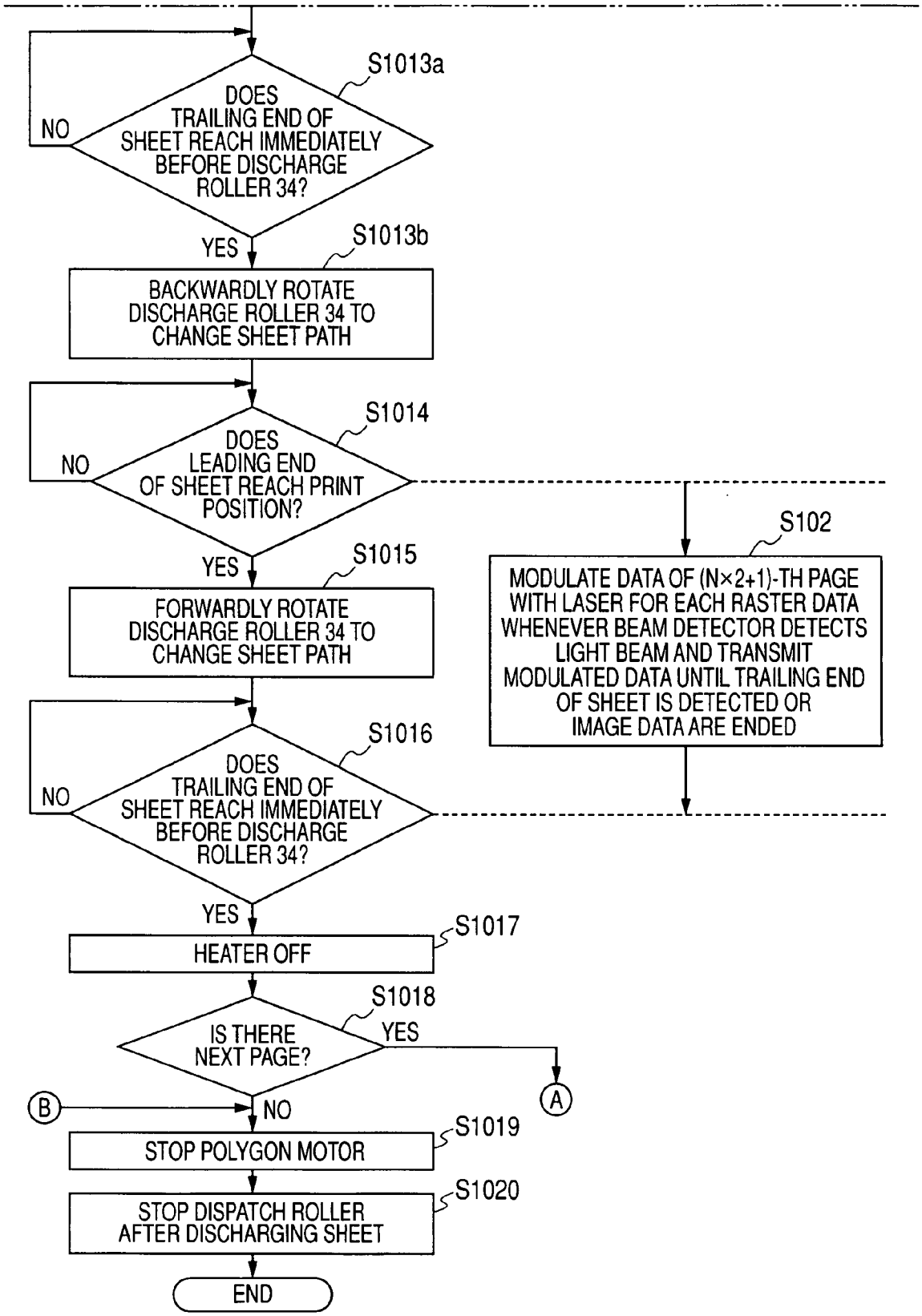

IMAGE FORMING APPARATUS, PROGRAM FOR IMAGE FORMING APPARATUS, AND DRIVER PROGRAM FOR IMAGE FORMING APPARATUS

CROSS-REFERENCE TO RELATED APPLICATIONS

This application claims priority from Japanese Patent Application No. 2006-208569, filed on Jul. 31, 2006, the entire subject matter of which is incorporated herein by reference.

TECHNICAL FIELD

Aspects of the present invention relate to an image forming apparatus, and more specifically, to an image forming apparatus capable of performing a print operation for sheets having two distinguishable sides with a method of setting the sheets in a print tray being fixed.

BACKGROUND

JP-A-2003-276285 discloses a print apparatus for performing a double-sided printing operation as well as a single-sided printing operation (refer to, for example, paragraph [0031] and so on). For example, JP-A-2003-276285 discloses a technique of printing four pages of a manuscript on two forming sheets, as one job, according to a double-sided printing sequence in which an image of a second page of the manuscript is printed on one side of a first forming sheet, the first forming sheet is turned over, an image of a first page of the manuscript is printed on the other side of the first forming sheet, the first forming sheet is discharged, an image of a fourth page of the manuscript is printed on one side of a second forming sheet, the second forming sheet is turned over, an image of a third page of the manuscript is printed on the other side of the second forming sheet, and the second forming sheet is discharged.

In such double-sided print apparatuses, the first forming sheet is discharged into a discharge tray odd page down, that is, the other side of the first forming sheet being directed downward, and then the second forming sheet is superimposed on the first forming sheet odd page down, that is, the other side of the second forming sheet being directed downward. As a result, the first and second forming sheets are piled up in a sequence of the first page, the second page, the third page and the fourth page of the manuscript from the bottom of the piled forming sheets.

Incidentally, among various kinds of sheets used in a print apparatus, there exist sheets having both sides distinguished from each other (hereinafter also referred to as dedicated sheets), for example, a single-sided glossy sheet, a single-sided watermarked sheet and a postcard for inkjet.

With an example of print for the single-sided sheet, for single-sided print, the single-sided sheet is set in a sheet tray of a print apparatus such that a print operation is performed for a watermarked side of the sheet. When the single-sided watermarked sheet is set in this way, print data can be printed on the watermarked side.

In the condition where the single-sided watermarked sheet is set in the print apparatus, for example, when a user attempts to form print data including image data of a first page to be printed on a watermarked side of the sheet and character data of a second page to be printed on a glossless side of the sheet, since the print apparatus first prints the character data of the second page, the character data are printed on the watermarked side while the image data are printed on the glossless side.

SUMMARY

Aspects of the invention provide an image forming apparatus which is capable of properly performing a print operation for a dedicated sheet with a method of setting the dedicated sheet in a print tray fixed, irrespective of single sided print or double sided print.

BRIEF DESCRIPTION OF THE DRAWINGS

FIG. 6 is a flow chart of a print control process in a both-side distinguished mode according to the first example;

DETAILED DESCRIPTION

<General Overview>

Figure 1:
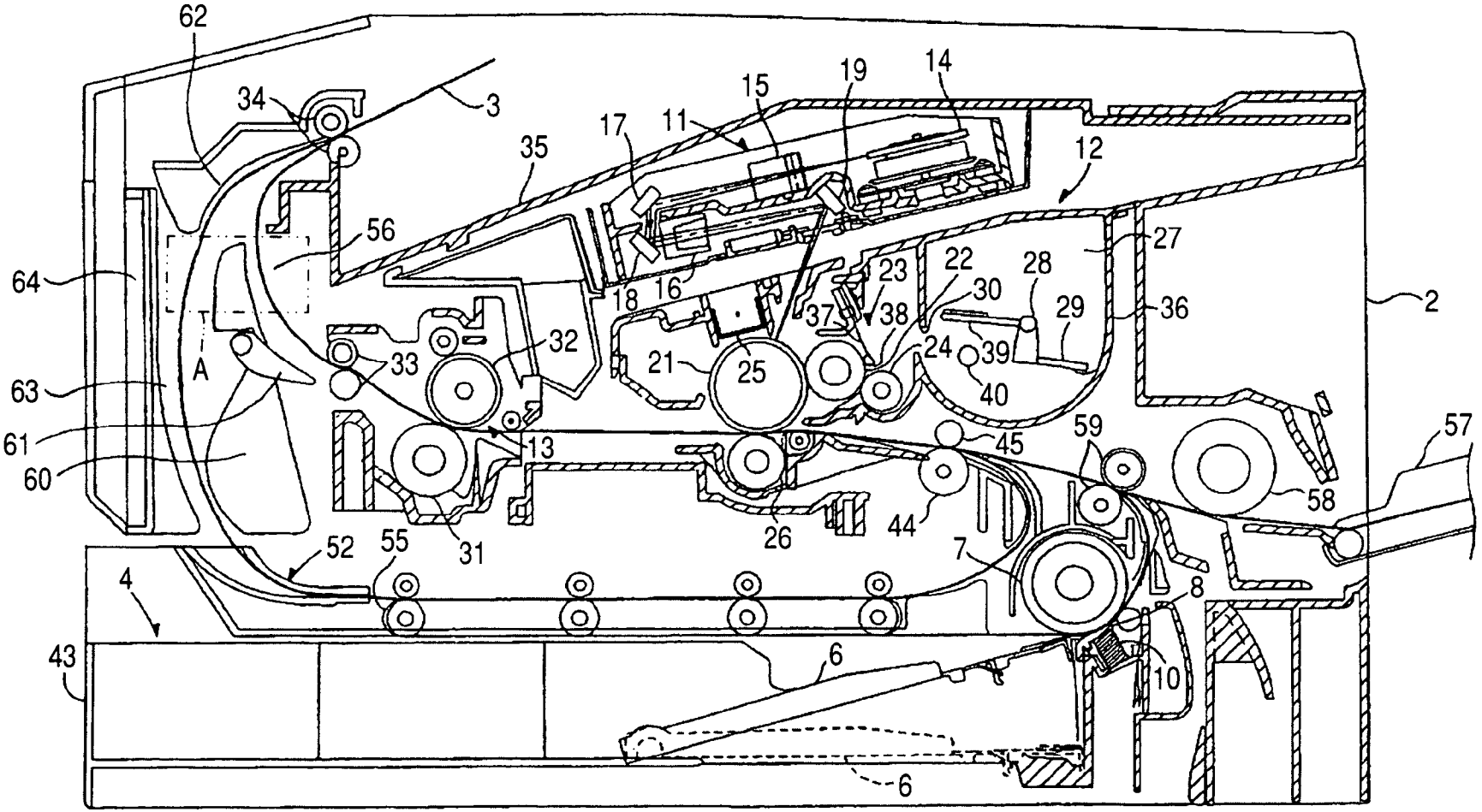
FIG. 1 is an exemplary sectional view showing a general configuration of a laser printer.

According to a first aspect of the invention, there is provided an image forming apparatus including: an image forming unit that forms an image related to forming data on one side of a sheet; a sheet tray that contains the sheet on which the image is formed by the image forming unit; a first conveying unit that conveys the sheet from the sheet tray to the image forming unit; a reversal unit that reverses a side facing direction of the sheet for the image forming unit; a second conveying unit that conveys the reversed sheet to the image forming unit; a discharging unit that discharges the sheet; a single-sided image forming unit that conveys the sheet from the sheet tray to the image forming unit through the first conveying unit, with the sheet being contained in the sheet tray in such a manner that a first side of the sheet faces toward a predetermined direction, forms an image on the first side of the sheet, and discharges the sheet to the discharging unit in a predetermined discharge state; a first double-sided image forming unit that conveys the sheet from the sheet tray to the image forming unit through the first conveying unit, forms an image of an even page on a first side of the sheet, reverses the sheet on which the even page is formed using the reversal unit, conveys the reversed sheet to the image forming unit through the second conveying unit, forms an image of an odd page on a second side of the sheet, and discharges the sheet to the discharging unit in a predetermined discharge state; and a second double-sided image forming unit that forms an image of an even page on the second side of the sheet contained in the sheet tray and an image of an odd page on the first side of the sheet, and discharges the sheet to the discharging unit in a predetermined discharge state.

According to a second aspect of the invention, there is provided an image forming apparatus including: an image forming unit that forms an image related to forming data on one side of a sheet; a sheet tray that contains the sheet on which the image is formed by the image forming unit; a first conveying unit that conveys the sheet contained in the sheet tray to the image forming unit; a reversal unit that reverses a side facing direction of the sheet for the image forming unit; a second conveying unit that conveys the reversed sheet from the reversal unit to the image forming unit; a discharging unit that discharges the sheet, the image forming apparatus being capable of performing double-sided print operation for the sheet; a reversal control unit that controls the reversal unit to reverse the sheet twice for double-sided print; a first image forming control unit that controls the image forming unit to form an image on a first side of the sheet related to first reversal through the reversal unit by the reversal control unit when the sheet related to the first reversal is conveyed to the image forming unit through the second conveying unit; a second image forming control unit that controls the image forming unit to form an image on the other side of the sheet when the sheet is conveyed to the image forming unit through the first conveying unit from the sheet tray or when the sheet related to second reversal through the reversal unit by the reversal control unit is conveyed to the image forming unit; and a discharge control unit that controls the discharging unit to discharge the sheet under conditions of the control by the first image forming control unit, the control by the second image forming control unit, and the second reversal through the reversal unit by the reversal control unit.

According to a third aspect of the invention, there is provided a driver program product embodied on a computer readable medium which, when executed by a computer connected to an image forming apparatus, enables the computer to control the image forming apparatus to perform predetermined operations, the predetermined operations including: conveying the sheet contained in a sheet tray to an image forming unit that forms an image; forming an image related to forming data on one side of the sheet; reversing a side facing direction of the sheet for the image forming unit; and discharging the sheet from the image forming apparatus, wherein the side facing direction of the sheet is twice reversed for double-sided image forming operation.

According to a fourth aspect of the invention, there is provided a method for double-sided printing, including: conveying a sheet from a tray of an image forming apparatus; reversing a side facing direction of the conveyed sheet; forming an image on a first side of the sheet; reversing the side facing direction of the sheet on which the image is formed on the first side thereof; forming an image on a second side of the sheet; and discharging the sheet in a predetermined discharge state.

According to a fifth aspect of the invention, there is provided a method for double-sided printing, including: conveying a sheet from a tray of an image forming apparatus: forming an image on a first side of the conveyed sheet; reversing a side facing direction of the sheet on which the image is formed on the first side thereof; forming an image on a second side of the reversed sheet; reversing the side facing direction of the sheet on which the image is formed on the second side thereof; and discharging the sheet in a predetermined discharge state.

<Illustrative Aspects>

Illustrative aspects of the invention will be described with reference to the accompanying drawings. FIG. 1 is an exemplary sectional view showing a general configuration of a laser printer 1 as an image forming apparatus according to an aspect of the invention. In FIG. 1, the laser printer 1 includes a feeder unit 4 for feeding sheets (not shown) in the bottom of a case 2. In FIG. 1, numeral 3 denotes a sheet, 6 denotes a sheet pressure plate, 7 denotes a feed roller, 8 denotes a friction separation member, 10 denotes a spring, 11 denotes a laser scanner unit, 12 denotes a developing unit, 13 denotes a fixing unit, 14 denotes a polygon mirror, 15 and 16 denote lenses, 17, 18 and 19 denote reflecting mirrors, 21 denotes a photosensitive drum, 22 denotes a developing roller, 23 denotes a developing chamber, 24 denotes a supplying roller, 25 denotes a charger, 26 denotes a transfer roller, 27 denotes a toner containing chamber, 28 denotes a rotation shaft, 29 denotes an agitator, 30 denotes an opening, 31 denotes a pressure roller, 32 denotes a heating roller, 33 denotes conveying rollers, 34 denotes discharge rollers, 35 denotes a face down sheet discharging portion, 36 denotes a cleaner, 37 denotes a thin-plate-like elastic plate, 38 denotes a contact portion, 39 denotes a face down sheet discharging portion, 40 denotes a light transmitting window, 43 denotes a sheet tray, 44 and 45 denote resistor rollers, 52 denotes a second reverse sheet feeding guide, 55 denotes reversal sheet conveying rollers, 56 denotes a discharge path, 57 denotes a manual insertion sheet tray, 58 denotes a manual supplying roller, 59 denotes conveying rollers, 60 denotes a sheet guiding tray, 61 denotes a guide, 62 denotes a reverse feed guiding portion, 63 denotes a reverse feeding path and 64 denotes a rear tray. A general structure of the laser printer is disclosed, for example, in US 2002/0039508 A1 and US 2002/0207871 A1, and therefore the detail of the laser printer 1 is omitted here. Instead, the entire disclosure of US 2002/0039508 A1 and US 2002/0207871 A1 are incorporated herein by the reference.

A pair of discharge rollers 34 is provided above the sheet guiding tray 60 and discharges a sheet guided and conveyed by the sheet guiding tray 60 to the face down sheet discharging portion 35. A sheet 3 is discharged from the face down sheet discharging portion 35 in such a manner that a sheet surface on which an image is formed immediately before the sheet is discharged becomes a bottom side.

In addition, the discharge rollers 34 function as a reversal unit for feeding a sheet to a reverse feeding path for formation of a duplex image. For the formation of the duplex image, a rotation direction is reversed immediately before the sheet conveyed in a discharge direction by the discharge rollers 34.

A reverse feed guiding portion 62 is provided around the discharge rollers 34, and a sheet is conveyed to a reverse feeding path 63 along the reverse feed guiding portion 62.

The reverse feeding path 63 is formed by the above-described sheet guiding tray 60 and a rear tray 64. The rear tray 64 guides the sheet 3, which is conveyed to the reverse feeding path 63, to a reversal conveying unit at a lower portion of the image forming apparatus in a closed position as shown in FIG. 1.

The reversal conveying unit is provided with a second reverse sheet feeding guide 52 and a plurality of pairs of reversal sheet conveying rollers 55 and supplies the sheet 3 conveyed through the reverse feeding path 63 to the contact portion between the photosensitive drum 21 and the transfer roller 26 again. Even for this double sided formation, a user does not need to set the sheet tray 43 again, contrary to a case where a single sided print is performed for a single sided watermarked sheet. Accordingly, irrespective of the single sided print and the double sided print, print for a dedicated sheet can be properly performed with a method of setting the dedicated sheet in the sheet tray 43 to be fixed.

In the laser printer 1 according to the above aspect, a surface of the photosensitive drum 21 is equally charged by the charger 25, and when the photosensitive drum 21 is irradiated with a laser modulated according to image information from the laser scan unit 11, an electrostatic latent image is formed on the surface of the photosensitive drum 21. The electrostatic latent image turns to a visible image with toner by the developing unit 12, and the visible image formed on the photosensitive drum 21 is conveyed to a print position by the photosensitive drum 21. At the print position, a sheet is supplied through the feed roller 7 and the resister rollers 45 and 46, and the visible image is transferred into the sheet by a transfer bias applied by the transfer roller 26. Toner remaining on the photosensitive drum 21 after transfer is recovered to the developing chamber 23 by the developing roller 22.

Next, the sheet is conveyed to the fixing unit 13, inserted and conveyed between the heating roller 32 and the pressure roller 31 of the fixing unit 13, and the visible image on the sheet is pressed, heated and fixed on the sheet. Then, the sheet is discharged to the face down sheet discharging portion 35 by the pair of conveying rollers 33, the guide 61, the sheet guiding tray 60 and the discharge rollers 34 to thereby complete a single sided image forming process of face down discharge.

A sheet reversal mechanism used for a double sided image forming process operates as follows. The upper side of a print sheet that passed through the above print mechanisms 12, 13, 21, etc.) is discharged outside the housing by the discharge rollers, and then the print sheet stops with a rear side thereof nipped between the discharge rollers. Then, the sheet nipped between the discharge rollers 34 is conveyed to the reverse feed guiding portion 62 by reverse rotation of the discharge rollers 34, and then the sheet is conveyed to the reverse feeding path 63 along the reverse feed guiding portion 62 with a side, which was a trailing end when the sheet passed through the print mechanisms, as the head. The sheet passed through the reverse feeding path 63 formed by the sheet guiding tray 60 and the rear tray 64 is guided to the pairs of reversal sheet conveying rollers 55 by the second reverse sheet feeding guide 52, and then is supplied to the contact portion between the photosensitive drum 21 and the transfer roller 26 again by the pairs of reversal sheet conveying rollers 55. At this time, the sheet is reversed such that a side which was the upper side when the sheet passed through the print mechanisms becomes a lower side and a side which was the head (left side in the figure) when the sheet passed through the print mechanisms becomes a trailing end (right side in the figure).

In addition, an image is formed on a back surface of the sheet in the same processes as the above described processes, and then the sheet is loaded on the face down sheet discharging portion 35 by the discharge rollers 34 with the back surface as the lower side. Thus, the double sided image forming process is ended.

This aspect provides different double-sided prints in addition to the single sided print and the double sided print of the above-described face down discharge and is configured such that an image is properly formed on the sheet 3 with the method of setting the sheet 3 in the sheet tray 43 being fixed.

Figure 2:
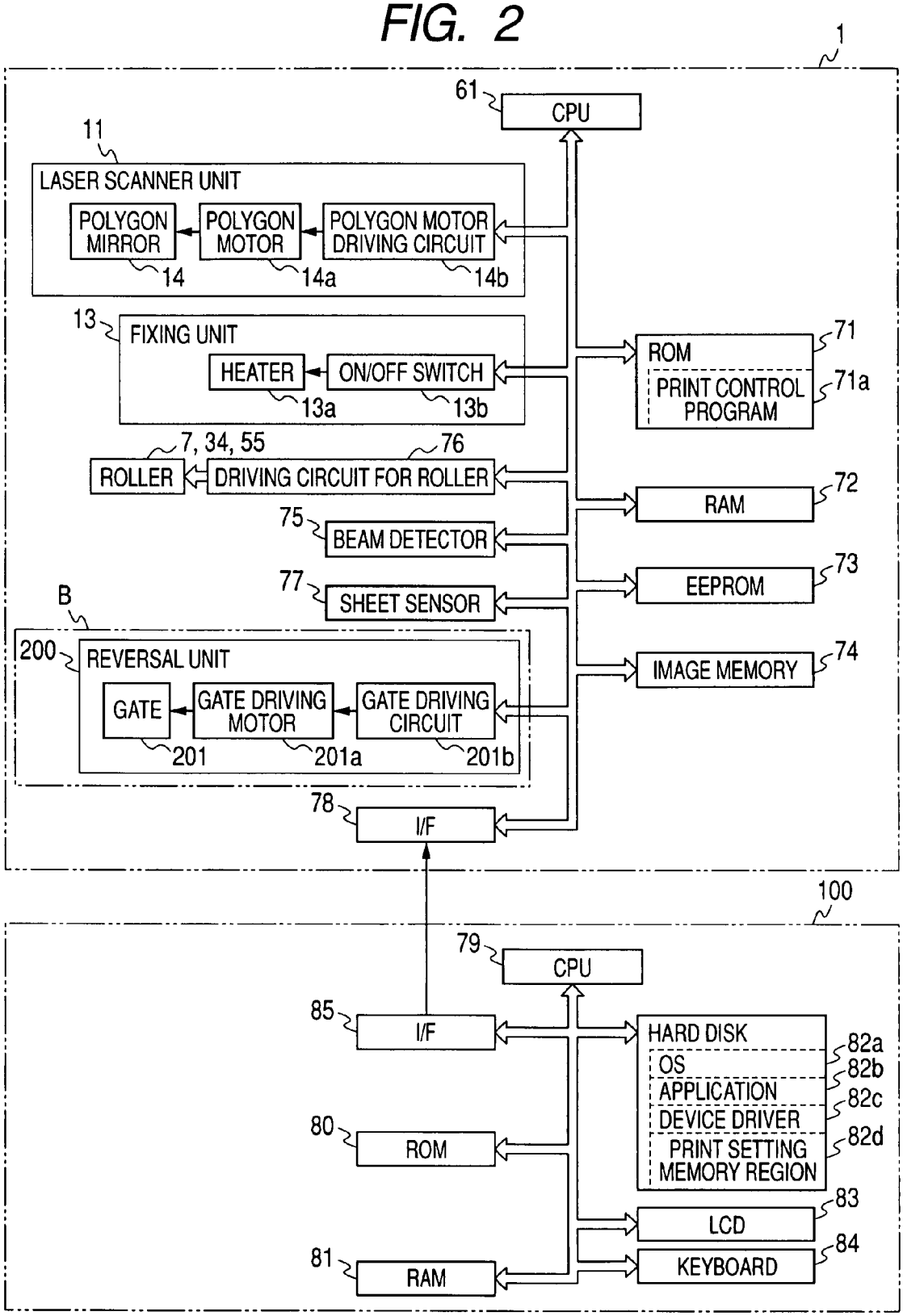
FIG. 2 is a block diagram showing an electrical configuration of a laser printer and a PC.

FIG. 2 is a block diagram showing an electrical configuration of the laser printer 1 and a personal computer (PC) 100. The laser printer 1 includes a CPU 61, a ROM 71, a RAM 72, an EEPROM 73, an image memory 74, a beam detector 75, a driving circuit 76 for various rollers, a sheet sensor 77 and an interface (I/F) 78, which are interconnected via bus lines, in addition to the above-described laser scanner unit 11, fixing unit 13, various rollers (feed roller 7, discharge rollers 34, conveying rollers 59, etc). In this figure, a reversal unit 200 has a configuration used in a second example which will be described later, and explanation thereof will be described later.

The CPU 61 controls operations of devices connected to the CPU 61 according to control programs pre-stored in the ROM 71. The ROM 71 is an unwritable memory in which control programs executed in the laser printer 1, fixed values and so on are stored, and a print control process shown in FIG. 5 and so on is executed according to a print control program 71*a* stored in the ROM 71. The RAM 72 is a volatile memory for temporarily storing various data when a program stored in the ROM 71 is executed. The EEPROM 73 is a writable non-volatile memory, and data stored in the EEPROM 73 remain unchanged even after the laser printer 1 is powered off. The image memory 74 is a memory for storing a bit image (bit data) for print and is configured by a dynamic RAM (DRAM) which is an inexpensive mass memory.

The laser scanner unit 11 includes a polygon motor 14*a* for driving the polygon mirror 14 and a polygon motor driving circuit 14*b* for controlling the driving of the polygon mirror 14*a* in addition to the above-described configuration. Rotation of the polygon mirror 14 is controlled by the polygon motor 14*a* whose driving is controlled by the polygon motor driving circuit 14*b*. The fixing unit 13 includes a heater 13*a* for heating the heating roller 32 and an ON/OFF switch 13*b* for controlling ON/OFF of the heater 13*a* in addition to the above-described configuration.

The beam detector 75 detects a light beam emitted from the polygon mirror 14 while being rotated. Whenever the light beam emitted from the polygon mirror 14 is detected, leaser modulated with image data are transmitted to the laser scanner unit 11 to make it possible to synchronize with the rotating polygon mirror 14. The driving circuit 76 for various rollers is a circuit for controlling motors to drive the various rollers (feed roller 7, discharge rollers 34, conveying rollers 59, etc.).

The sheet sensor 77 is a sensor for sensing a position of the sheet 3 and is arranged in plural numbers at predetermined locations. Each sheet sensor 77 may be configured by a detector rotating when the detector contacts the sheet 3, and a photo interrupter for detecting rotational movement of the detector. In this aspect, the sheet sensor 77 is placed immediately before the transfer roller 26, which is the print position, immediately before the discharge rollers 34, etc.

The I/F 78 is a unit based on known standards for electrically interconnecting different apparatuses. The laser printer 1 is connected to the PC 100 through the I/F 78 and exchanges data (receives image data from) with the PC 100. The received image data is converted into a bit image which is then written into the image memory 74.

The PC 100 includes a CPU 79, a ROM 80, a RAM 81, a hard disk 82, an LCD 83, a keyboard 84 and an I/F 85.

The CPU 79 controls parts interconnected through bus lines based on fixed values and programs stored in the ROM 80. The ROM 80 is an unwritable memory in which control programs executed in the PC 100 and so on are stored. The RAM 81 is a memory for temporarily storing various data.

The hard disk 82 is a writable non-volatile memory for storing an operating system (OS) 82*a*, an application 82*b*, a device driver 82*c* and a print setting memory region 82*d*. The OS 82*a* is basic software, for example, Microsoft Windows®. The application 82*b* is software for creating various characters, figures and so on. Image data created using the application 82*b* are printed by the laser printer 1. The device driver

82*c* properly drives the laser printer 1 connected to the PC 100, and the print setting memory process shown in FIG. 3 and so on is performed according to the device driver 82*c*. The print setting memory region 82*d* stores print setting conditions set by a user according to the device driver 82*c*.

Figure 3A:
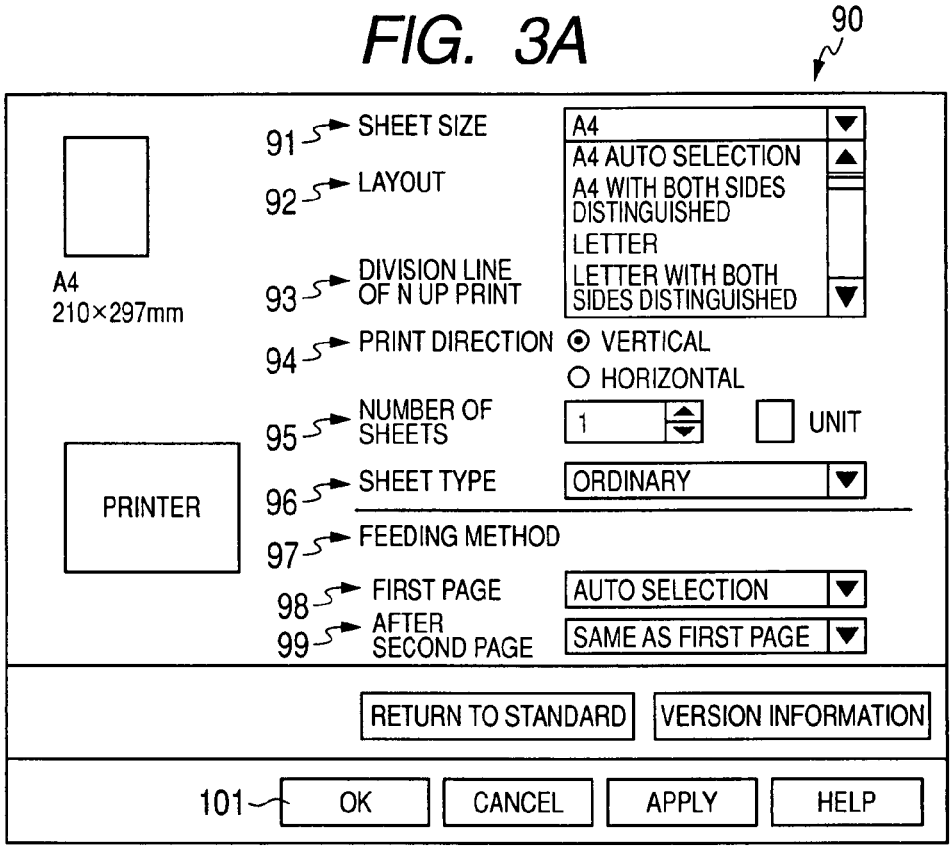
FIGS. 3A and 3B are views showing a print setting display screen displayed on an LCD of a PC when there is a print setting request of a laser printer from a user.
Figure 3B:
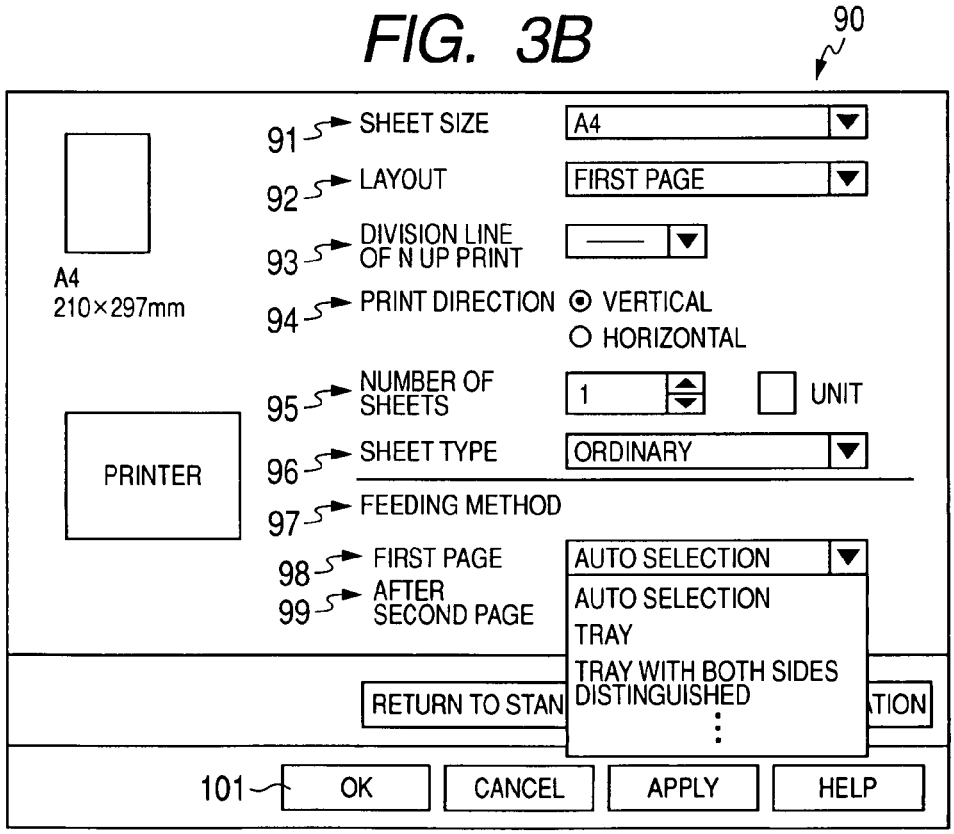

FIGS. 3A and 3B are views showing a print setting display screen 90 displayed on the LCD 83 of the PC 100 when there is a print setting request of a laser printer from a user, in which FIG. 3A shows a state where a sheet size 91 is selected, and FIG. 3B shows a state where a sheet feeding method 98 is selected.

The print setting display screen includes, its setting items, a sheet size 91, a layout 92, a division line of N up print 93, print direction 94, copy number 95, sheet type 96, and feeding method 97 including first page 98 and after second page 99. Each item is optional, and after selecting each item, when a user selects "OK" 101, printing is performed with a print setting selected by the user. The print setting conditions set through the screen is stored in the print setting memory region 82*d*.

For example, sheet size 91 is configured such that its selection contents are indicated in a pull-down manner. That is, as shown in FIG. 3A, sheet size is configured to be selected among "A4", "A4 with both sides distinguished", "Letter" and "Letter with both sides distinguished" from the top. "A4 with both sides distinguished" represents a sheet size of "A4" having both sides distinguished from each other (for example, a single sided glossy sheet, a sheet having a surface on which a form image is printed (a single sided watermarked sheet), etc.). Likely, "Letter with both sides distinguished" represents a sheet size of "Letter" having both sides distinguished from each other.

In addition, first page 98 as feeding method 97 is also configured such that its selection contents are indicated in a pull-down manner. That is, as shown in FIG. 3B, first page 98 is configured to be selected from among "auto selection", "Tray", "Tray with both sides distinguished", and so on. When a sheet is supplied from the tray, it is configured to select one of the sides of the sheet. This allows a user to set whether or not a sheet to be printed after this has both sides distinguished from each other.

Figure 4A:
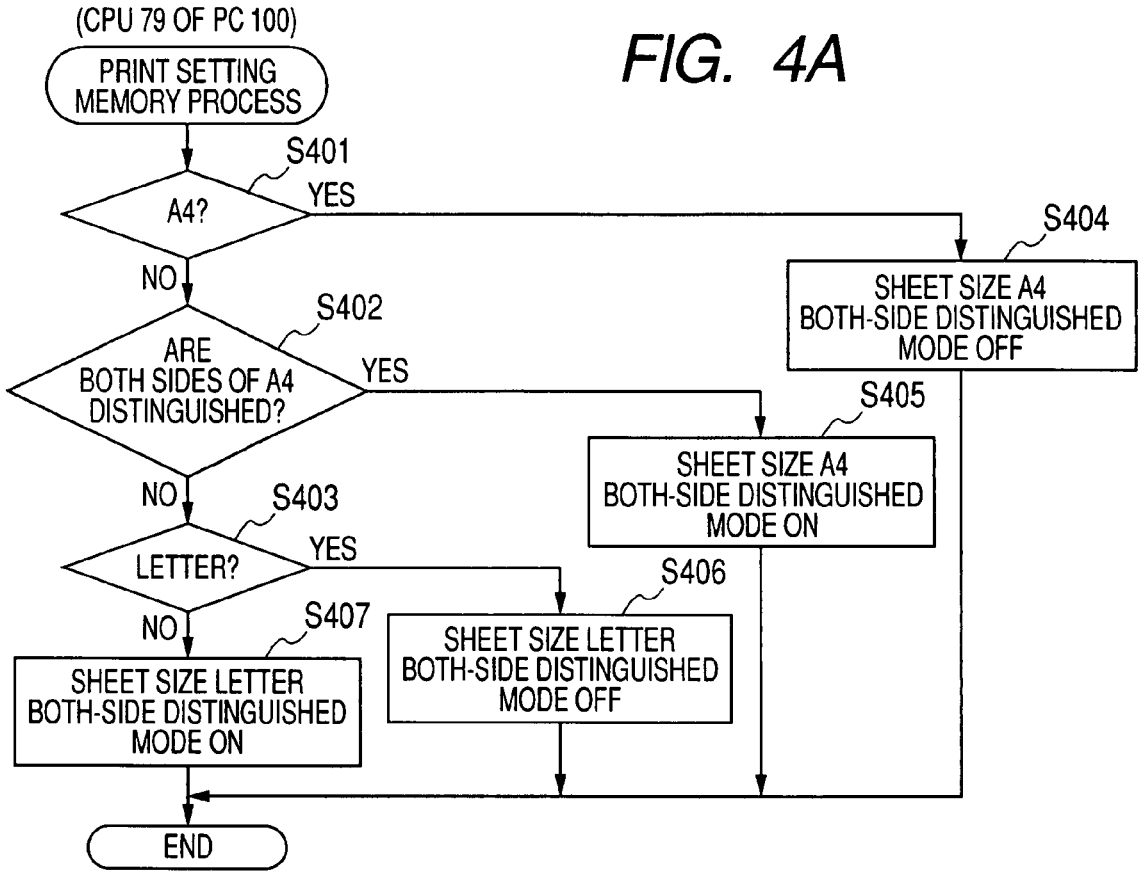
FIGS. 4A and 4B are flow charts of a print setting memory process to memorize print setting conditions set by a user in a print setting memory region.
Figure 4B:
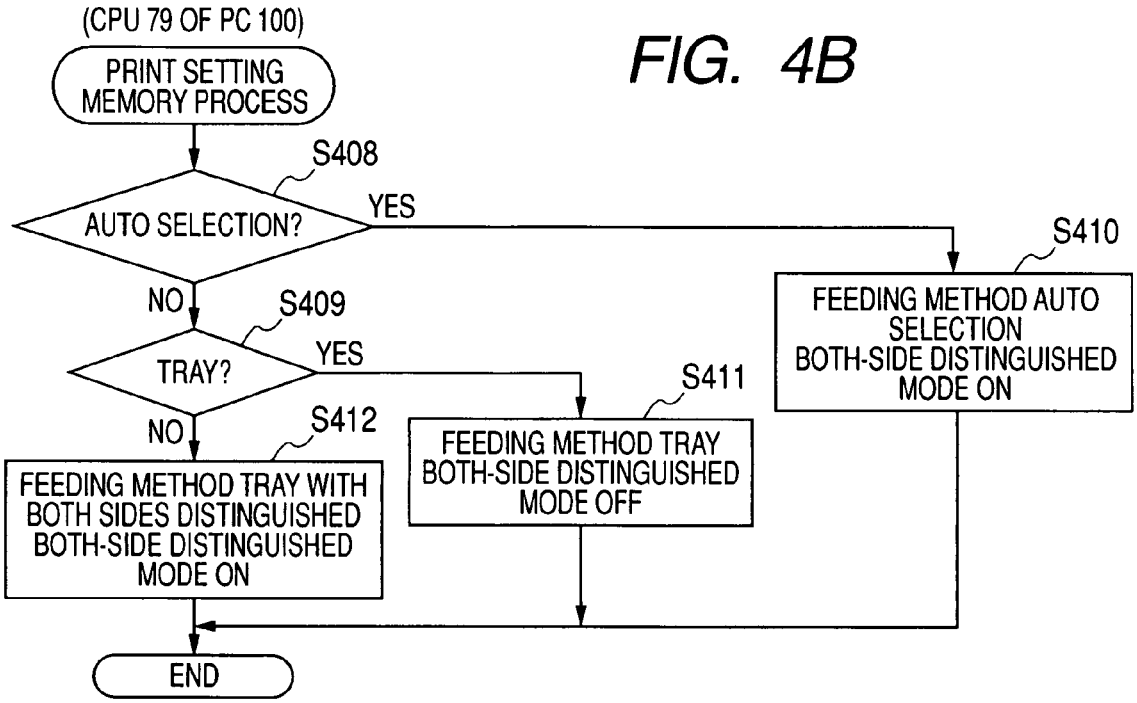

FIGS. 4A and 4B are flow charts of a print setting memory process to memorize the print setting conditions set by the user in the print setting memory region 82*d*. FIG. 4A is a flow chart of a print setting memory process to memorize a print setting for the sheet size 91. FIG. 4B is a flow chart of a print setting memory process to memorize a print setting for feeding method 97 of first page 98.

In FIG. 4A, first, it is determined whether the sheet size 91 selected is "A4" (S401), "A4 with both sides distinguished" (S402), or "Letter" (S403) in order. As a result of the determination, when the sheet size 91 is "A4" (Yes in S401), the sheet size is set to be "A4" and a both-side distinguished mode is set to be "OFF" (S404). When the sheet size 91 is "A4 with both sides distinguished" (Yes in S402), the sheet size is set to be "A4" and the both-side distinguished mode is set to be "ON" (S405). When sheet size 91 is "Letter" (Yes in S403), the sheet size is set to be "Letter" and the both-side distinguished mode is set to be "OFF" (S406). Then, the set print setting conditions are stored in the print setting memory region 82*d*, and then this process is ended. In addition, when sheet size 91 is not one of the above-set print setting conditions (No in S401 to S403), the sheet size is set to be "Letter" and the both-side distinguished mode is set to be "ON" (S407). Then, the set print setting conditions are stored in the print setting memory region 82*d*, and then this process is ended.

In contrast, in FIG. 4B, first, it is determined whether feeding method 97 of first page 98 selected is "auto selection" (S408) or "tray" (S409) in order. As a result of the determination, when feeding method 97 is "auto selection" (Yes in S408), the feeding method is set to be "auto selection" and a both-side distinguished mode is set to be "OFF" (S410). When feeding method 97 is "tray" (Yes in S409), the feeding method is set to be "tray" and the both-side distinguished mode is set to be "OFF" (S411). Then, the set print setting conditions are stored in the print setting memory region 82*d*, and then this process is ended. In addition, when the feeding method is not one of the above-set print setting conditions (No in S408 and S409), the feeding method is set to be "tray with both sides distinguished" and the both-side distinguished mode is set to be "ON" (S412). Then, the set print setting conditions are stored in the print setting memory region 82*d*, and then this process is ended.

Figure 5:
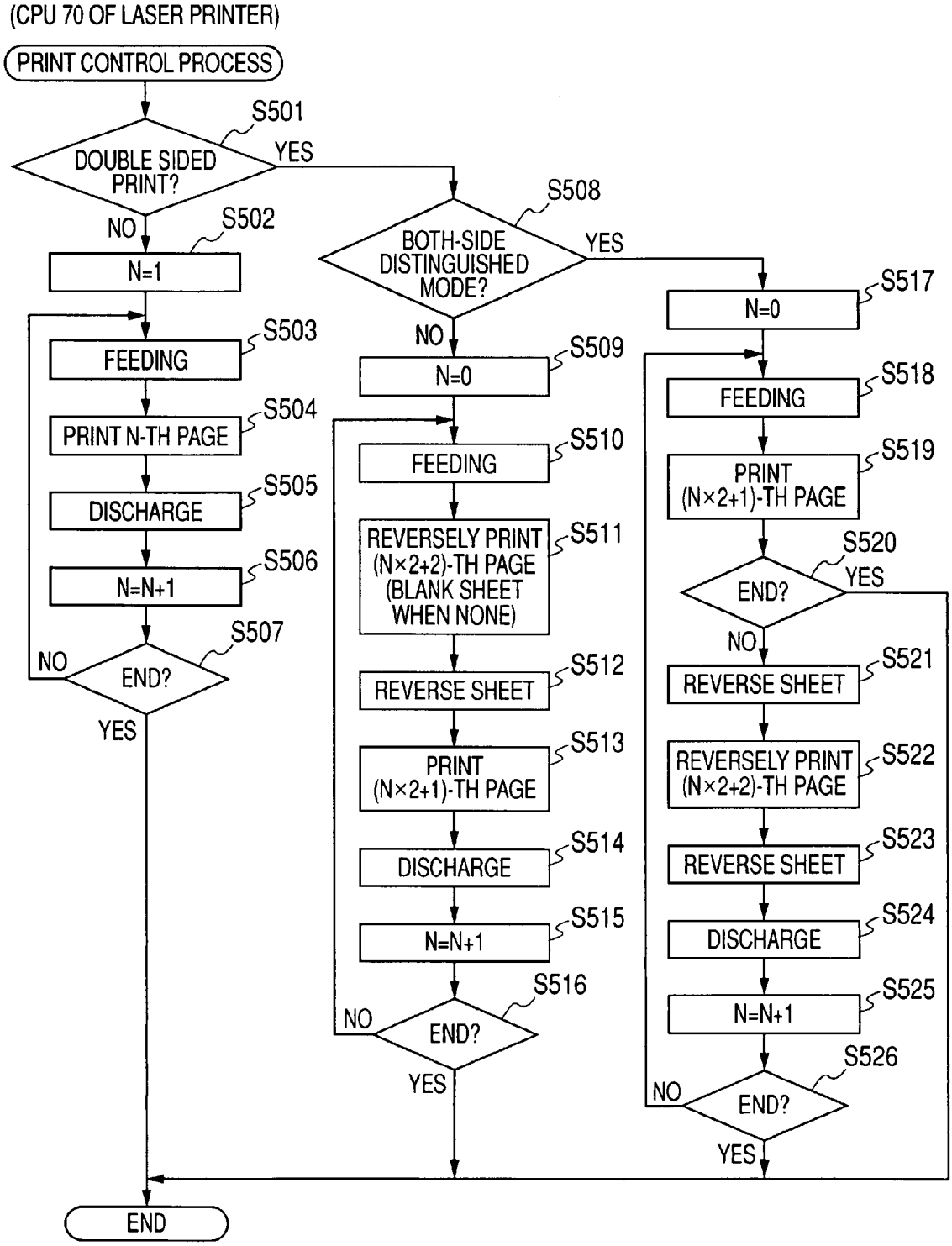
FIG. 5 is a flow chart roughly illustrating a print control process according to a first example.

FIG. 5 is a flow chart roughly illustrating a print control process. This print control process is a process for printing an image related to image data transmitted from the PC 100 on a sheet, which is performed by the CPU 61 of the laser printer 1 according to the print control program 71*a*.

This process is performed when a print instruction is transmitted from a user through the PC 100. First, it is determined whether or not an instructed print is a double sided print from print setting conditions included in the transmitted image data (S501). When the instructed print is not the double sided print (No in S501), it is determined that the instructed print is a single sided print, and then a counter N is set to be "1" (S502). Thereafter, like the above-described single sided print, a sheet contained in the sheet tray 43 begins to be supplied (S503), an N-th page of the image data is printed on one side of the sheet (S504), and then the sheet is discharged (S505). Then, "1" is added to the counter N (S506), and it is determined whether the counter N is ended (that is, whether or not there is a next page) (S507). When the counter N is ended (Yes in S507), this process is ended. When the counter N is not ended (No in S507), the process is repeated from S503. Thus, a normal single sided print is completed.

In contrast, as a result of the determination at S501, when the instructed print is the double sided print (Yes in S501), it is further determined whether or not the instructed print is in a both-side distinguished mode (S508). When the instructed print is not in the both-side distinguished mode (No in S508), it is assumed to be the above-described normal double sided print, and the counter N is set to be "0" (S509). Thereafter, like the above-described double sided print, a sheet contained in the sheet tray 43 begins to be supplied (S510), and then an (N×2+2)-th page (even page) of the image data is reversed and printed on one side of the sheet (S511).

Such reversal print is made because it is assumed that, in this aspect, when the second page (odd page) is considered as a bound short side of an A4-sized sheet stacked in a vertical direction, the second page is vertically reversed with the first page (odd page). Accordingly, it is possible to print the page without reversing the page.

Then, the sheet is reversed (S512), an (N×2+1)-th page (odd page) is printed (S513), and then the sheet is discharged (S514). Thereafter, "1" is added to the counter N (S515) and it is determined whether or not the counter N is ended (that is, whether or not there is a next page) (S516). When the counter N is ended (Yes in S516), this process is ended. When the counter N is not ended (No in S516), the process is repeated from S510. Thus, a normal double sided print is completed.

In contrast, as a result of the determination at S508, when the instructed print is in the both-side distinguished mode (Yes in S508), the counter N is set to be "0" (S517). Thereafter, a sheet contained in the sheet tray 43 begins to be supplied (S518), and then an (N×2+1)-th page (odd page) of the image data is printed on one side of the sheet (S519). Next, it is determined whether or not the counter N is ended (that is, whether or not there is a next page) (S520). When the counter N is not ended (No in S520), the sheet is reversed (S521), and then an (N×2+2)-th page (even page) of the image data is reversed and printed (S522). Then, the sheet is reversed (S523) and then the sheet is discharged (S524). Thereafter, "1" is added to the counter N (S525) and it is determined whether or not the counter N is ended (that is, whether or not there is a next page) (S526). When the counter N is ended (Yes in S526), this process is ended. When the counter N is not ended (No in S526), the process is repeated from S518. When it is determined at S520 or S526 that the counter N is ended (Yes in S520 or S526), the process is ended.

First Example of Print Control Process

Now, the above-described steps S517 to S526 (in the case of the both-side distinguished rode) will be described in more detail with reference to a flow chart of FIG. 6. FIG. 6 is a flow chart of a first example related to a print control process in the both-side distinguished mode.

In this case, first, the counter N is set to be "0" (S601), the feed roller 7 is rotated to supply a sheet contained in the sheet tray 43 (S602), the conveying rollers 59 serve as dispatch rollers, the resister rollers 44 and 45 are rotated at a normal speed (S603), the heater 13*a* of the fixing unit 13 is set to be "ON" (S604), the discharge rollers 34 are forwardly rotated to change a sheet path (S605), the polygon motor 14*a* is rotated (S606), and repeated determination is made at S607 until a predetermined sheet sensor 22 detects that the sheet 3 reaches a print position (No in S607). In S602, when the sheet sensor 22 detects that the fed sheet 3 reaches the dispatch rollers, driving of the feed roller 7 is stopped and the feed roller 7 freely rotates.

When it is determined that the sheet reaches the print position (Yes in S607), a process for modulating laser with data of an (N×2+1)-th page (odd page) with laser for each raster data whenever the beam detector 75 detects a light beam emitted from the polygon mirror 14 and transmitting the modulated data is performed at S101 in a different routine until the sheet sensor 22 detects that a trailing end of the sheet 3 passes the print position or image data are ended (S101). By this step S101, the (N×2+1)-th page (odd page) is printed on one side of the sheet 3 conveyed through the sheet tray 43, the feed roller 7, the conveying rollers 59 and the resister rollers 44 and 45.

Next, it is determined whether or not there is a next page (S608). When there is the next page (Yes in S608), repeated determination is made until a predetermined sheet sensor 22 detects that the trailing end of the sheet 3 reaches a location immediately before the discharge rollers 34 (No in S609). When the trailing end of the sheet 3 reaches immediately before the discharge rollers 34 (Yes in S609), the discharge rollers 34 are backwardly rotated to change a sheet path (S610). Accordingly, the sheet 3 is again conveyed to the print position through the reverse feeding path 63 and the plurality of pairs of reversal sheet conveying rollers 55, and repeated determination is made until the sheet sensor 22 detects that the sheet reaches the print position (No in S611).

When it is determined that the sheet reaches the print position (Yes in S611), a process for modulating data of an (N×2+2)-th page (even page) with laser for each raster data whenever the beam detector 75 detects a light beam emitted from the polygon mirror 14 and transmitting the modulated data is performed at S102 in a different routine until the sheet sensor 22 detects that a trailing end of the sheet 3 passes the print position or image data are ended (S102). By this step S102, the (N×2+2)-th page (even page) is printed on the other side of the sheet 3 conveyed through the reverse feeding path 63, the plurality of pairs of reversal sheet conveying rollers 55, the conveying rollers 59 and the resister rollers 44 and 45.

During this step S102, in this process, the discharge rollers 34 are changed to a forward rotation normal speed to change the reverse feeding path (S612). In this aspect, it is assumed that the trailing end of the sheet passed the discharge rollers 34 already at this timing. Next, repeated determination is made until the sheet sensor 22 detects that the trailing end of the sheet reaches immediately before the discharge rollers 34 (No in S613). When it is determined that the trailing end of the sheet reaches immediately before the discharge rollers 34 (Yes in S613), the heater 13*a* is set to be "OFF" (S614), "1" is added to the counter N (S615), and the discharge rollers 34 are backwardly rotated and the speed of rotations of the dispatch rollers increases (S616). This backward rotation continues until the trailing end of the sheet passes the position of the discharge rollers 34, and then the discharge rollers 34 returns to forward rotation. Accordingly, the sheet 3 is again reversed and passes the reverse feeding path 63, the plurality of pairs of reversal sheet conveying rollers 55, the print position, the fixing unit 13 and the conveying rollers 33. Thereafter, the sheet with the (N×2+2)-th page (even page) printed on the upper side of the sheet is discharged to the face down sheet discharging portion 35 through the forwardly rotating discharge rollers 34.

Next, it is determined whether or not there is a next page (S617). When there is the next page (Yes in S617), the process is repeated from S602. When there is no next page (No in S617), the polygon motor 14*a* is stopped (S618), the dispatch rollers are stopped after the sheet 3 is discharged (S619), and then, the process is ended.

In this way, by the print control process in the both-side distinguished mode, contrary to the normal double sided print at S508 to S516 in the flow chart shown in FIG. 5, an odd page is printed on one side of the sheet while an even page is printed on the other side of the sheet.

For example, when an image is to be printed on a watermarked side of a single sided watermarked sheet as the sheet 3, when the single sided watermarked sheet is set in the sheet tray 43 with the watermarked side being directed downward, the image can be printed on the watermarked side.

In the condition where the single sided watermarked sheet is set in the sheet tray 43 in the same state as the single sided print, for example, when a user attempts to form print data including image data of a first page (odd page) to be printed on the watermarked side and character data of a second page (even page) to be printed on a glossless side, the character data of the second page (even page) are printed on the watermarked side while the image data are printed on the glossless side in the normal double sided print (S508 to S516) described with the flow chart of FIG. 5.

However, in this case, by setting the print as the both-side distinguished mode, the image data of the first page (odd page) is printed on the watermarked side while the character data of the second page (even page) is printed on the glossless side (the other side).

In addition, in the discharged state, the lower side of the lowermost sheet becomes a first page, the upper side of the lowermost sheet becomes a second page, a third page facing the second page continues, etc. Accordingly, there is no need to change and arrange sheets for bookbinding.

Accordingly, even when a user performs a double-sided formation, there is no need to set the single sided watermarked sheet again in the sheet tray 43, contrary to the single-sided print. Accordingly, irrespective of the single-sided print and the double-sided print, an image can be properly printed on the dedicated sheet with a method of setting the dedicated sheet in the sheet tray 42 to be fixed.

In addition, in the mechanisms of the above aspect, the sheet is turned over by reversing a traveling direction of the sheet. This method has an advantage of simplicity over a mechanism that turns over the sheet by reversing a lateral direction of the sheet since a mechanical mechanism uses some common sheet conveying mechanisms. However, there arises a problem in that the top and bottom of the sheet are reversed by such reversal. Accordingly, in a case of printing in a non-both-side distinguished mode, there is a problem in that the top and bottom of the sheet are reversed contrary to user's intention. That is, the top of the sheet is discharged to the right side of the figure in the single sided print while the top of the sheet is discharged to the left side of the figure in the conventional double-sided print. However, by using the both-side distinguished mode, even in the double-sided print, it is possible to conform the top and bottom of the sheet to the single sided print.

In addition, in the above aspect, during the reversing process at S523, the heater is set to be OFF by the process at S614. Accordingly, the printed image is not effected. Likely, since the dispatch rollers speed up at S616, the sheet passes through the position of the heater at a high speed. Accordingly, the sheet can avoid an effect of residual heat of the heater.

In a case where a sheet with both sides undistinguished from each other is used, when the both-side distinguished mode is released, the number of sheet reversing processes is reduced, and thus it is possible to perform a print operation at a higher speed than the both-side distinguished mode.

In addition, when a user intends to print an odd page on a glossless side and an even page on a watermarked side (for example, print a document including a photograph image in only an even page), a desired print result can be obtained by releasing the both-side distinguished mode.

In addition, in this aspect, in the both-side distinguished mode, since print data are printed in an order of an odd page and an even page, there is no need to store the even page while odd page is being printed. Accordingly, it is possible to further reduce memory capacity consumed in the double-sided print over a case where print data are printed in an order of an even page and an odd page.

Second Example of Print Control Process

Figure 7A:
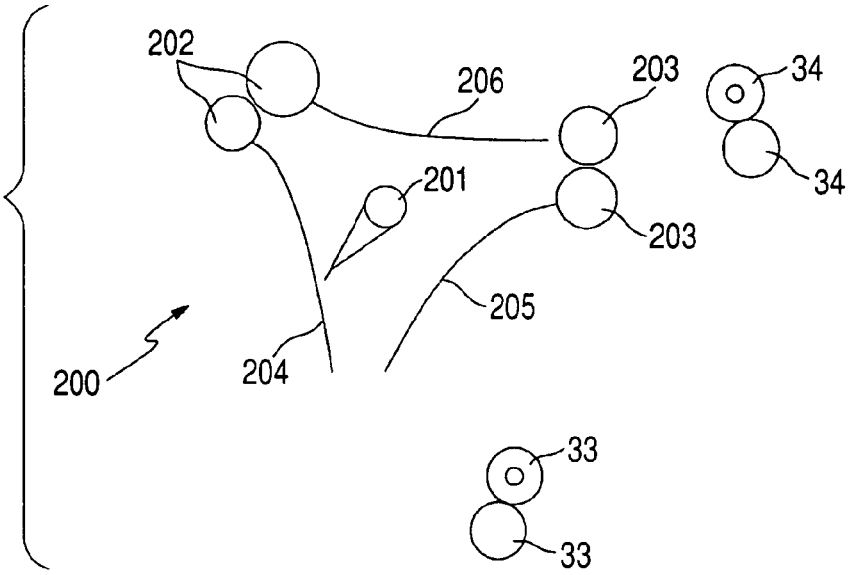
FIGS. 7A-7C are views showing a reversal mechanism added to a laser printer to implement a print control process in a both-side distinguished mode according to a second example.
Figure 7B:
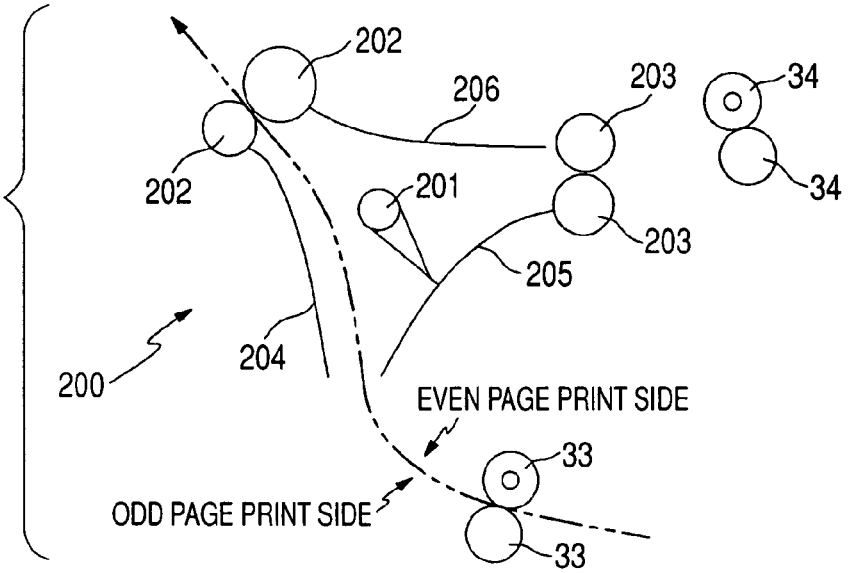
Figure 7C:
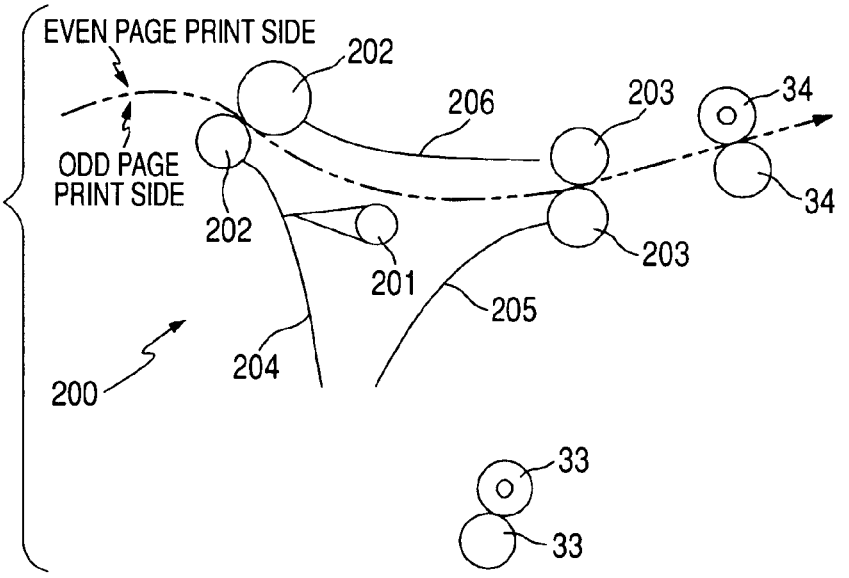

Next, a second example related to the print control process in the both-side distinguished mode of the above first example will be described with reference to FIGS. 7A-7C. FIGS. 7A-7C are views showing the reversal mechanism 200 added to the laser printer 1 shown in FIG. 1 to implement a print control process in a both-side distinguished mode according to a second example. FIGS. 7A, 7B and 7C show different positions of a gate 201 of the reversal mechanism 200.

The reversal mechanism 200 is arranged in a portion A surrounded by an alternate long and short dash line of FIG. 1, and includes a pair of first reversal rollers 202, a pair of second rollers 203, a first conveying guide 204 that extends from the conveying rollers 33 to the first reversal rollers 202, a second conveying guide 205 that extends from the conveying rollers 33 to the second rollers 203, a third conveying guide 206 that extends between the first reversal rollers 202 and the second rollers 203, and a gate 201 that is rotatably arranged in a space surrounded by the first, second and third conveying guides 204, 205 and 206. As shown in FIG. 2, the gate 201 is connected to a gate driving motor 201*a* through a gate driving circuit 201*b* and can be rotatably arranged with the gate driving motor 201*a* as a driving source.

With the reversal mechanism 200 as constructed above, the gate 201 is arranged in the position shown in FIG. 7B, and, for example, when the sheet 3 with an even page printed on the top side thereof is conveyed from the conveying rollers 33, the gate 201 prevents the sheet 3 from being conveyed to the second rollers 203, and the sheet 3 is conveyed to the first reversal rollers 202 along the first conveying guide 204 and then is further conveyed to the opposite side to the conveying rollers 33 by rotation of the first reversal rollers 202.

In addition, as shown in FIG. 7C, when the first reversal rollers 202 are backwardly rotated with the sheet 3 being conveyed by the first reversal rollers 202 and the gate 201 is set in the position shown in FIG. 7C, the sheet 3 is discharged to the face down sheet discharging portion 35 through the third conveying guide 206, the second rollers 203 and the discharge rollers 34 with the top side of the sheets on which the even page is printed being directed upward.

By setting the gate 201 in the position shown in FIG. 7A, the sheet 3 conveyed from the conveying rollers 33 can be conveyed to the discharge rollers 34 through the second conveying guide 205 and the second rollers 203.

Figure 8:
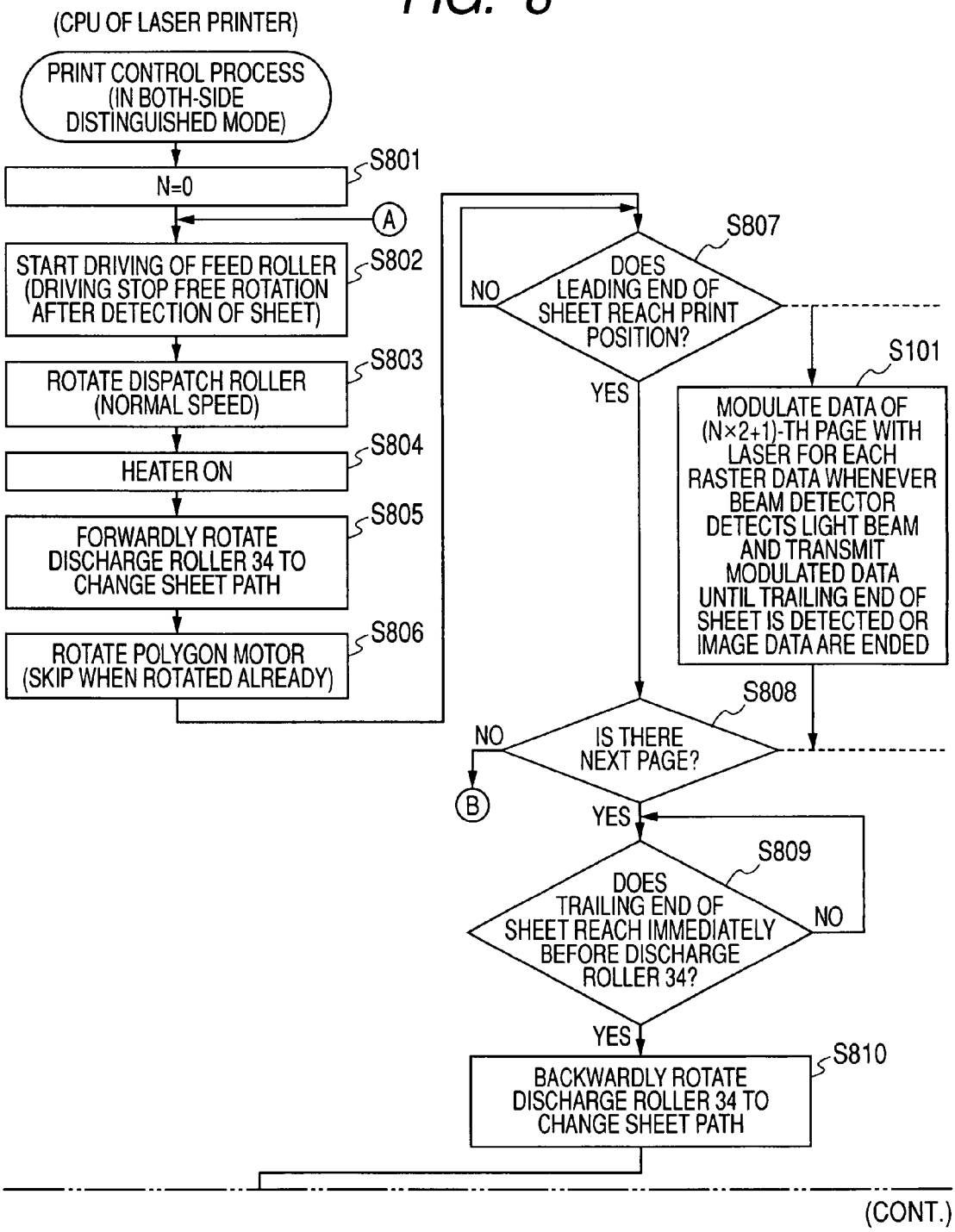
FIG. 8 is a flow chart of the print control process in the both-side distinguished mode according to the second example.

Next, the print control process in the both-side distinguished mode of the second example will be described with reference to FIG. 8. In this process, first, the counter N is set to be "0" (S801), the feed roller 7 is rotated to supply the sheet 3 contained in the sheet tray 43 (S802), the conveying rollers 59 as dispatch rollers, and the resister rollers 44 and 45 are rotated at a normal speed (S803), the heater 13*a* of the fixing unit 13 is set to be "ON" (S804), the discharge rollers 34 are forwardly rotated to change a sheet path (S805), the polygon motor 14*a* is rotated (S806), and repeated determination is made until a predetermined sheet sensor 22 detects that the sheet 3 reaches a print position (No in S807). In S802, when the sheet sensor 22 detects that the fed sheet 3 reaches the dispatch rollers, driving of the feed roller 7 is stopped and the feed roller 7 freely rotates.

When it is determined that the sheet 3 reaches the print position (Yes in S807), a process for modulating data of an (N×2+1)-th page (odd page) with laser for each raster data whenever the beam detector 75 detects a light beam emitted from the polygon mirror 14 and transmitting the modulated data is performed at S101 in a different routine until the sheet sensor 22 detects that a trailing end of the sheet 3 passes the print position or image data are ended (S101). By this step S101, the (N×2+1)-th page (odd page) is printed on one side of the sheet 3 conveyed through the sheet tray 43, the feed roller 7, the conveying rollers 59 and the resister rollers 44 and 45.

Next, it is determined whether or not there is a next page (S808). When there is the next page (Yes in S808), repeated determination is made until the sheet sensor 22 detects that the trailing end of the sheet 3 reaches a location immediately before the discharge rollers 34 (No in S809). When the trailing end of the sheet 3 reaches immediately before the discharge rollers 34 (Yes in S809), the discharge rollers 34 are backwardly rotated to change a sheet path (S810). Accordingly, the sheet 3 is again conveyed to the print position through the reverse feeding path 63 and the plurality of pairs of reversal sheet conveying rollers 55, and repeated determination is made until the sheet sensor 22 detects that the sheet 3 reaches the print position (No in S811).

When it is determined that the sheet reaches the print position (Yes in S811), a process for modulating data of an (N×2+2)-th page (even page) with laser for each raster data whenever the beam detector 75 detects a light beam emitted from the polygon mirror 14 and transmitting the modulated data is performed at S102 in a different routine until the sheet sensor 22 detects that a trailing end of the sheet 3 passes the print position or image data are ended (S102). By this step S102, the (N×2+2)-th page (even page) is printed on the other side of the sheet 3 conveyed through the reverse feeding path 63, the plurality of pairs of reversal sheet conveying rollers 55, the conveying rollers 59 and the resister rollers 44 and 45.

During this step S102, in this process, the gate 201 of the reversal mechanism 200 is set in the position shown in FIG. 7B (S812). In this example, it is assumed that the trailing end of the sheet passed the reversal mechanism 200 already at this timing.

Next, it is determined whether or not next page feed starting conditions are satisfied (S813). The next page feed starting condition includes a first condition that there is a next page (next sheet) and a second condition that the sheet 3 reversed by the reversal mechanism 200 does not interfere with a sheet 3 to be fed from now. That is, it is required to start next feed without waiting reversal completion of the sheet 3 by the reversal mechanism 200 and prevent both sheets 3 from interfering with each other in the reversal mechanism 200. Specifically, assuming that a time taken to complete reversal is Tr, a conveying speed of the sheet to be fed from now is V, and a distance from the sheet tray 43 to the reversal mechanism 200 is L, it is required that time T taken until print for a next sheet starts satisfies the condition: $Tr-L/V<T<Tr$.

In addition, when both of the above two conditions are satisfied (Yes in S813), the feed roller 7 is rotated to feed the next sheet 3 contained in the sheet tray 43 (S814). In contrast, when none of the above two conditions is satisfied (No in S813), S814 skips and repeated determination is made until the sheet sensor 22 detects that the trailing end of the sheet reaches immediately before the first reversal rollers 202 (No in S815). In addition, it is determined at S815 whether or not feed of the next page at S814 is ended.

When it is determined that the trailing end of the sheet reaches immediately before the first reversal rollers 202 (Yes in S815), "1" is added to the counter N (S816), the gate 201 is set in the position shown in FIG. 7C, and the first reversal rollers 202 are backwardly rotated (S817). Accordingly, the sheet 3 is discharged to the face down sheet discharging portion 35 through the first reversal rollers 202, the second rollers 203 and the discharge rollers 34 with even page being directed upward.

Next, it is determined whether or not there is a next page (S818). When there is the next page (Yes in S818), the process is repeated from S802. When there is no next page (No in S818), the polygon motor 14*a* is stopped (S819), the dispatch rollers are stopped after the sheet 3 is discharged (S819), the heater 13*a* is set to be "OFF", and then the process is ended.

In this way, by the print control process in the both-side distinguished mode of the second example, like the first example, an odd page is printed on one side of the sheet while an even page is printed on the other side of the sheet, showing the same effect as the first example, contrary to the normal double sided print at S508 to S516 in the flow chart shown in FIG. 5.

In addition, in the first example, since it is required to convey the sheet 3 again to the print position through the discharge rollers 34, the reverse feeding path 63 and the plurality of pairs of reversal sheet conveying rollers 55 in order to reverse the sheet 3 after the even page is printed, the next sheet is restrained from being fed during the re-conveying.

In the second example, since the reversal mechanism 200 can reverse the sheet 3 irrespective of a path through which the sheet passes the print position, feed of the next sheet 3 can start while the reversal mechanism 200 reverses the sheet 3, thereby performing double sided print at a higher speed than the first example.

Third Example of Print Control Process

Figure 9:
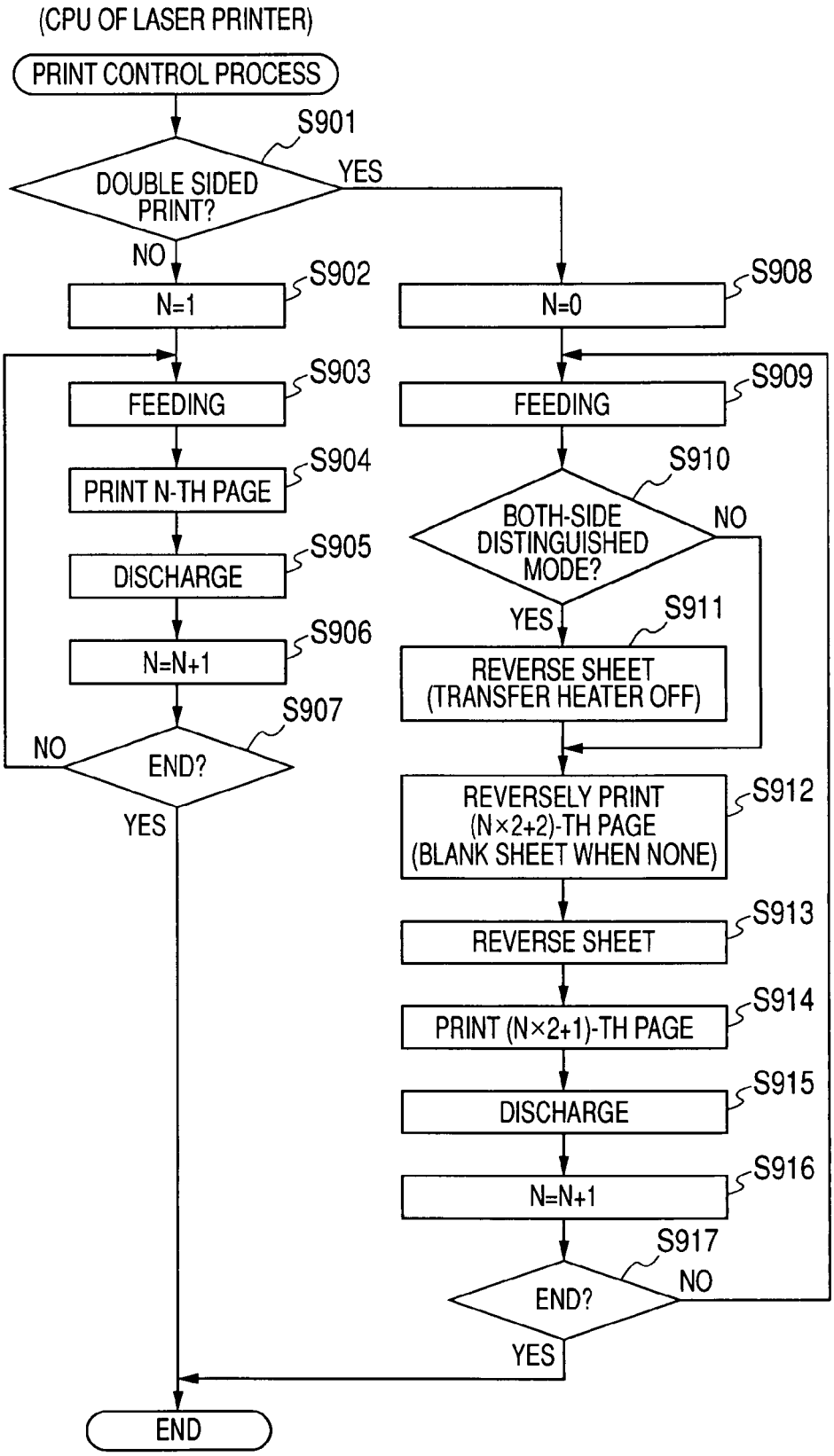
FIG. 9 is a flow chart roughly illustrating a print control process according to a third example.

FIG. 9 is a flow chart roughly illustrating a print control process according to a third example. This print control process of the third example is a process for printing an image related to image data transmitted from the PC 100, which is performed by the CPU 61 of the laser printer 1 according to the print control program 71*a*.

In this process, first, it is determined whether or not an instructed print is a double sided print from print setting conditions included in transmitted image data (S901). When the instructed print is not the double sided print (No in S901), it is determined that the instructed print is a single sided print, and then a counter N is set to be "1" (S902). Thereafter, like the above-described single sided print, a sheet contained in the sheet tray 43 begins to be supplied (S903), an N-th page of the image data is printed on one side of the sheet (S904), and then, the sheet is discharged (S905). Then, "1" is added to the counter N (S906), and it is determined whether the counter N is ended (that is, whether or not there is a next page) (S907). When the counter N is ended (Yes in S907), this process is ended. When the counter N is not ended (No in S907), the process is repeated from S903. Thus, a normal single sided print is completed.

In contrast, as a result of the determination at S901, when the instructed print is the double sided print (Yes in S901), the counter N is set to be "0" (S908). Thereafter, a sheet contained in the sheet tray 43 begins to be supplied (S909), and then it is determined whether or not the instructed print is in a both-side distinguished mode (S910).

When it is determined that the instructed print is in the both-side distinguished mode (Yes in S910), the sheet 3 is reversed (S911), and then an (N×2+2)-th page (even page) is reversed and printed on one side of the sheet 3 (S912).

In contrast, when it is determined that the instructed print is not in the both-side distinguished mode (No in S910), S911 is skipped, that is, an (N×2+2)-th page (even page) is reversed and printed on one side of the sheet 3 (S912), without reversing the sheet 3.

Thereafter, the sheet is reversed (S913), an (N×2+1)-th page (odd page) of the image data is printed (S914), and then the sheet is discharged (S915). Thereafter, "1" is added to the counter N (S916) and it is determined whether or not the counter N is ended (that is, whether or not there is a next page) (S917). When the counter N is ended (Yes in S917), this process is ended. When the counter N is not ended (No in S917), the process is repeated from S909.

That is, in the print control process of the third example, when the instructed print is in the both-side distinguished mode, the sheet 3 is reversed before an image is printed on the sheet 3, an even page is printed on the reversed sheet 3 and the sheet 3 is again reversed to print an odd page.

Figure 10:
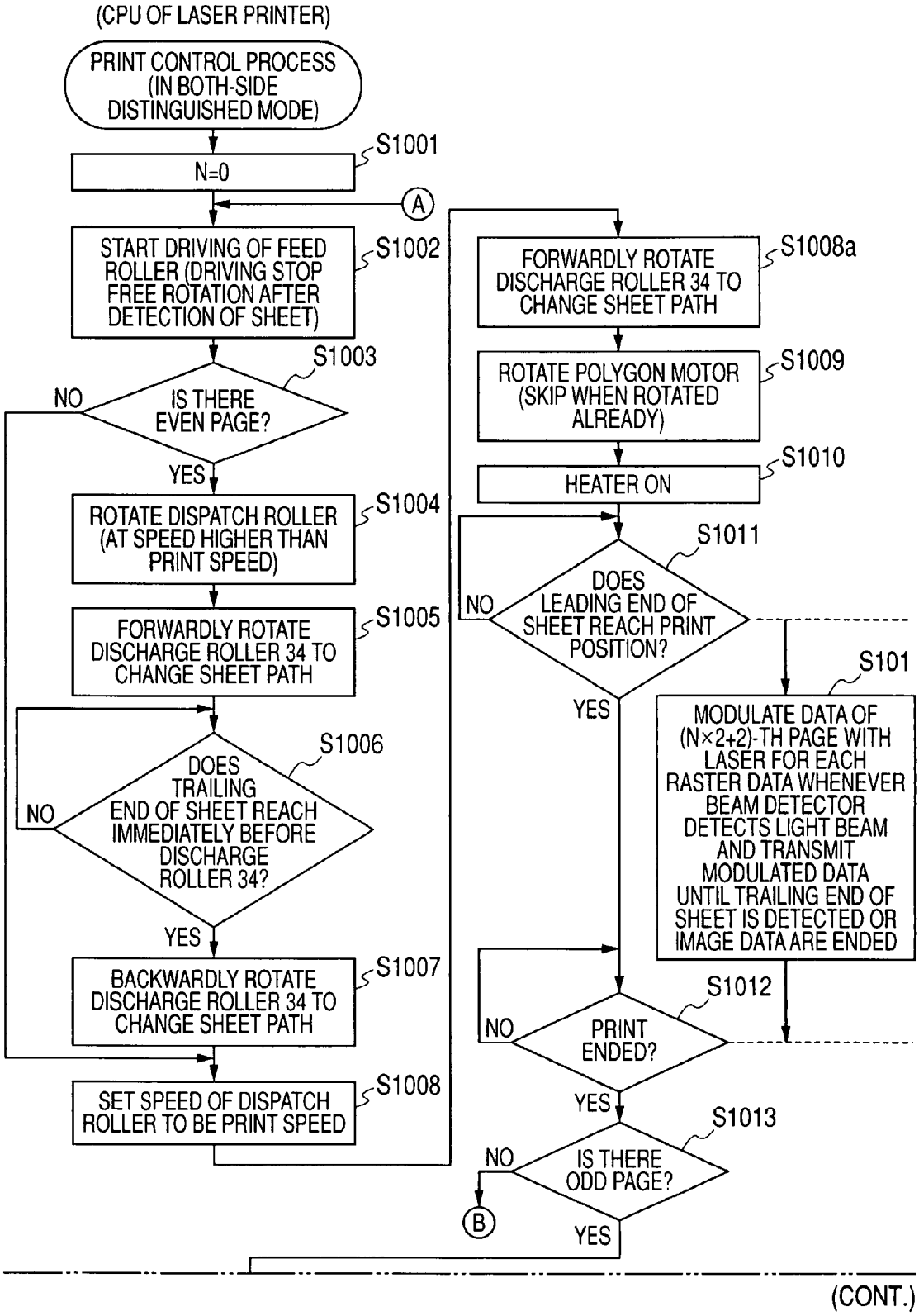
FIG. 10 is a flow chart of a print control process in a both-side distinguished mode according to the third example.

Now, a process of the double sided print in the print control process of the third example will be described in more detail with reference to FIG. 10. FIG. 10 is a flow chart of a print control process in the double-sided print.

In this process, first, the counter N is set to be "0" (S1001), the feed roller 7 is rotated to feed a sheet contained in the sheet tray 43 (S1002), and it is determined whether or not there is an even page (S1003). In S1002, when the sheet sensor 22 detects that the fed sheet 3 reaches the dispatch rollers, driving of the feed roller 7 is stopped and the feed roller 7 freely rotates.

When there is the even page (Yes in S1003), the conveying rollers 59 as the dispatch rollers and the resister rollers 44 and 45 are rotated at a speed higher than a normal print speed (S1004), the discharge rollers 34 are forwardly rotated to change a sheet path (S1005), and determination is made until the sheet sensor 22 detects that the trailing end of the sheet reaches a location immediately before the discharge rollers 34 (No in S1006). When it is determined that the trailing end of the sheet reaches immediately before the discharge rollers 34 (Yes in S1006), the discharge rollers 34 are backwardly rotated to change the sheet path 63 (S1007). Accordingly, the sheet is reversed and is fed into the reverse feeding path. That is, in the third example, when there is the even page, the sheet is conveyed through the sheet tray 43, the feed roller 7, the conveying rollers 59, the resister rollers 44 and 45, the print position, the fixing unit 13 and so on without printing an image on the sheet 3, and then the sheet 3 is reversed by the discharge rollers 34.

In contrast, when the even page does not exist (No in S1003), S1004 to S1007 are skipped.

Next, a speed of the dispatch rollers are set to be a print speed (S1008), the discharge rollers 34 are forwardly rotated to change a sheet path (S1008*a*), the polygon motor 14*a* is rotated (S1009), the heater 13*a* is set to be "ON" (S1010), and repeated determination is made at S1011 until the sheet sensor 22 detects that a leading end of the sheet 3 reaches the print position (No in S1011). When it is determined that the leading end of the sheet reaches the print position (Yes in S1011), a process for modulating data of an (N×2+2)-th page (even page) with laser for each raster data whenever the beam detector 75 detects a light beam emitted from the polygon mirror 14 and transmitting the modulated data is performed at S101 in a different routine until the sheet sensor 22 detects that a trailing end of the sheet 3 passes the print position or image data are ended (S101). By this step S101, the (N×2+2)-th page (even page) is printed on one side of the sheet 3 conveyed through the sheet tray 43, the feed roller 7, the conveying rollers 59 and the resister rollers 44 and 45.

Next, it is determined whether or not the print operation is ended (S1012). The determination at S1012 is repeated until the print operation is ended. When the print operation is ended (Yes in S1012), it is determined whether or not there is an odd page (S1013). When there is the odd page (Yes in S1013), repeated determination is made until the sheet sensor 22 detects that the trailing end of the sheet 3 reaches a location immediately before the discharge rollers 34 (No in S1013*a*). When the trailing end of the sheet 3 reaches immediately before the discharge rollers 34 (Yes in S1013*a*), the discharge rollers 34 are backwardly rotated to change a sheet path (S1013*b*). Accordingly, the sheet 3 is again conveyed to the print position through the reverse feeding path 63 and the plurality of pairs of reversal sheet conveying rollers 55, and repeated determination is made until the sheet sensor 22 detects that the leading end of the sheet 3 reaches the print position (No in S1014).

When it is determined that the sheet reaches the print position (Yes in S1014), a process for modulating data of an (N×2+1)-th page (odd page) with laser for each raster data whenever the beam detector 75 detects a light beam emitted from the polygon mirror 14 and transmitting the modulated data is performed at S102 in a different routine until the sheet sensor 22 detects that the trailing end of the sheet 3 passes the print position or image data are ended (S102). By this step S102, the (N×2+1)-th page (odd page) is printed on the other side of the sheet 3 conveyed through the reverse feeding path 63, the plurality of pairs of reversal sheet conveying rollers 55, the conveying rollers 59 and the resister rollers 44 and 45.

During this step S102, in this process, the discharge rollers 34 are forwardly rotated to change a conveying path (S1015). In this example, it is assumed that the trailing end of the sheet passed the discharge rollers 43 already at this timing. Repeated determination is made until the sheet sensor 22 detects that the trailing end of the sheet reaches immediately before the discharge rollers 34 (No in S1016). When it is determined that the trailing end of the sheet reaches immediately before the discharge rollers 34 (Yes in S1016), the heater 13*a* is set to be "OFF" (S1017). Next, it is determined whether or not there is a next page (S1018). When there is the next page (Yes in S1018), the process is repeated from S1002. When there is no next page (No in S1018), the polygon motor 14*a* is stopped (S1019), the dispatch rollers are stopped after the sheet 3 is discharged (S1020), and then the process is ended. Thus, the sheet 3 is discharged to the face down sheet discharging portion 35 through the discharge rollers 34 with the (N×2+1)-th page (odd page) being directed downward.

In this way, by the print control process in the both-side distinguished mode of the third example, since the sheet 3 is reversed before an image is printed on the sheet 3, the image can be formed on an opposite side of the sheet 3, contrary to the double-sided print which is not in the both-side distinguished mode as illustrated by the flow chart shown in FIG. 9. Accordingly, even in this case, irrespective of the single sided print and the double sided print, a user can properly print an image on a dedicated sheet with a method of setting the dedicated sheet in the sheet tray 42 fixed.

According to another aspect of the invention, the image forming apparatus can properly print an image on a dedicated sheet with a method of setting the dedicated sheet in a print tray fixed.

Specifically, with an example of print for a single sided sheet as the sheet, for single sided print, the single sided sheet is set in the sheet tray such that a print operation is performed for a watermarked side of the sheet. When the single sided watermarked sheet is set in this way, print data can be printed on the watermarked side.

In contrast, in the condition where the single sided watermarked sheet is set in the sheet tray in the same state as the single sided print, for example, when a user attempts to form print data including image data of a first page (odd page) to be printed on the watermarked side and character data of a second page (even page) to be printed on a glossless side, the character data of the second page (even page) are printed on the watermarked side while the image data are printed on the glossless side in the first double-sided image forming unit. In this case, by the second double-sided image forming unit, the character data of the second page (even page) is formed on the glossless side (the other side) while the image data of the first page (odd page) is formed on the watermarked side (the one side).

Accordingly, even when a user performs a double-sided formation, there is no need to set the single sided watermarked sheet again in the sheet tray, contrary to the single-sided print. Accordingly, irrespective of the single-sided print and the double-sided print, an image can be properly printed on the dedicated sheet with a method of setting the dedicated sheet in the sheet tray to be fixed.

According to still another aspect of the invention, with the simple control that the sheet is reversed before the image of the even page is formed on the one side of the sheet, the image of the even page can be formed on an opposite side of the sheet, contrary to the first double-sided image forming unit.

According to still another aspect of the invention, with the simple control that the image of the odd page is first formed on one side of the sheet, the image of the even page can be formed on an opposite side of the sheet, contrary to the first double-sided image forming unit. In addition, since the even page is formed after the odd page, there is no need to store the even page, which results in further reduction of memory capacity consumed for forming, as compared to a case where the odd page is formed after the even page.

According to still another aspect of the invention, the sheet reversed by the fourth reversal control unit can be discharged to the discharging unit along the same path as the first double-sided image forming unit.

According to still another aspect of the invention, while the sheet is being discharged to the discharging unit, a next sheet can be conveyed to the image forming unit through the first conveying unit.

According to still another aspect of the invention, it is possible to automatically meet the user's request.

According to still another aspect of the invention, with the driver program for the image forming apparatus according to the third aspect, a user can set which to perform, the first double-sided forming step or the second double-sided forming step, through the computing apparatus.

According to still another aspect of the invention, the image forming apparatus can properly print an image on a dedicated sheet with a method of setting the dedicated sheet in a print tray to be fixed.

Specifically, with an example of print for a single sided sheet as the sheet, for single sided print, the single sided sheet is set in the sheet tray such that a print operation is performed for a watermarked side of the sheet. When the single sided watermarked sheet is set in this way, print data can be printed on the watermarked side, and the sheet can be discharged to the discharging unit with the watermarked side facing downward.

In contrast, in the condition where the single sided watermarked sheet is set in the sheet tray in the same state as the single sided print, for example, when a user attempts to form print data including image data of a first page (odd page) to be printed on the watermarked side and character data of a second page (even page) to be printed on a glossless side, in the first method, the sheet contained in the sheet tray is conveyed to the image forming unit through the first conveying unit, an image according to the image data of the first page (odd page) is formed on the watermarked side of the sheet by the second image forming instructing unit, the sheet is first reversed by the reversal control unit through the reversal unit, the sheet is again conveyed to the image forming unit through the second conveying unit, an image according to the character data of the second page (even page) is formed on the glossless side of the sheet by the first image forming instructing unit, the sheet is second reversed by the reversal control unit through the reversal unit, and the sheet is discharged to the discharging unit by the discharge control unit with the watermarked side facing downward.

In addition, in the second method, the sheet contained in the sheet tray is conveyed to the image forming unit through the first conveying unit, the sheet is first reversed by the reversal control unit through the reversal unit without forming the image by the image forming unit, the sheet is conveyed to the image forming unit through the second conveying unit, the image according to the character data of the second page (even page) is formed on the glossless side of the sheet by the second image forming instructing unit, the sheet is second reversed by the reversal control unit through the reversal unit, the sheet is again conveyed to the image forming unit through the second conveying unit, the image according to the image data of the first page (odd page) is formed on the watermarked side of the sheet by the first image forming instructing unit, and the sheet is discharged to the discharging unit by the discharge control unit with the watermarked side facing downward.

Accordingly, even when a user performs a double-sided formation, there is no need to set the single sided watermarked sheet again in the sheet tray, contrary to the single-sided print. Accordingly, irrespective of the single-sided print and the double-sided print, an image can be properly printed on the dedicated sheet with a method of setting the dedicated sheet in the sheet tray fixed.

The present invention is not limited to the above aspects. For example, the following aspects also fall within the technical scope of the present invention.

In the above aspects, description has been given of a case where the single side watermarked sheet is used as an example of a sheet having both sides distinguished from each other. However, the sheet may also be a single-sided glossy sheet.

Further, in the above aspects, description has been given of a case where the laser printer 1 is used as an example of the image forming apparatus. However, the image forming apparatus may be an inkjet printer, a multi-function device having a printer function, and the like. When the inkjet printer is used as the image forming apparatus, a postcard for inkjet, in which one side of the sheet is designed for inkjet printing, may be adopted.

What is claimed is:

1. An image forming apparatus comprising:

a sheet tray configured to contain a sheet;

an image forming unit configured to form a first image and a second image on a first side and a second side of the sheet, respectively;

a first conveying unit that conveys the sheet from the sheet tray to the image forming unit;

a discharging unit that includes a first pair of rollers, the discharging unit being configured to discharge the sheet from the image forming apparatus by rotating the first pair of rollers in a forward direction when a gate is in a first position and to reverse the sheet from the first side to the second side or from the second side to the first side by rotating the rollers in a reverse direction before the sheet is fully discharged from the image forming apparatus;

a second conveying unit that conveys the reversed sheet from the discharging unit to the image forming unit;

a reversal unit that includes a second pair of rollers and the gate, the reversal unit being configured to reverse the sheet from the second side to the first side or from the first side to the second side by rotating the second pair of rollers in a forward direction and moving the gate from the first position to a second position before rotating the second pair of rollers in a reverse direction and moving the gate from the second position to a third position; and a processor that controls the image forming apparatus to carry out each of the following modes:

a single-sided image forming mode that conveys the sheet from the sheet tray to the image forming unit through the first conveying unit, forms an image on the first side of the sheet, and conveys the sheet to the discharging unit in a predetermined discharge state;

a first double-sided image forming mode that conveys the sheet from the sheet tray to the image forming unit through the first conveying unit, forms the first image on the first side of the sheet, reverses the sheet from the first side to the second side, conveys the reversed sheet to the image forming unit through the second conveying unit, forms the second image on the second side of the sheet, and discharges the sheet to the discharging unit in a predetermined discharge state; and a second double-sided image forming mode that forms the first image on the second side of the sheet and the second image on the first side of the sheet and conveys the sheet to the discharging unit in a predetermined discharge state.

2. The image forming apparatus according to claim 1, wherein the second double-sided image forming mode comprises:

a first reversal control step that conveys the sheet from the sheet tray to the image forming unit through the first conveying unit and reverses the sheet from the first side to the second side using the discharging unit without forming an image on the first side or second side of the sheet;

a first forming control step that conveys the reversed sheet from the discharging unit to the image forming unit through the second conveying unit and forms the first image on the second side of the sheet;

a second reversal control step that reverses the sheet from the second side to the first side using the discharging unit after the first image is formed by the image forming unit;

a second forming control step that conveys the reversed sheet from the discharging unit to the image forming unit through the second conveying unit and forms the second image on the first side of the sheet; and a discharge control step that conveys the sheet from the image forming unit to the discharging unit in the predetermined discharge state after the second image is formed by the image forming unit.

3. The image forming apparatus according to claim 1, wherein the second double-sided image forming mode comprises:

a first forming control step that conveys the sheet from the sheet tray to the image forming unit through the first conveying unit from the sheet tray and forms the second image on the first side of the sheet;

a first reversal control step that reverses the sheet from the first side to the second side using the discharge unit after the second image is formed by the image forming unit;

a second forming control step that conveys the reversed sheet from the discharging unit to the image forming unit through the second conveying unit and forms the first image on the second side of the sheet;

a second reversal control step that reverses the sheet from the second side to the first side using the reversal unit after the first image is formed by the image forming unit; and a discharge control step that conveys the reversed sheet from the reversal unit to the discharging unit in the predetermined discharge state.

4. The image forming apparatus according to claim 3, wherein the discharge control step further conveys the reversed sheet from the discharging unit to the image forming unit through the second conveying unit and conveys the sheet back to the discharging unit without forming another image on the sheet.

5. An image forming apparatus comprising:

a sheet tray configured to contain a sheet;

an image forming unit configured to form an image on one side of the sheet;

a first conveying unit that conveys the sheet from the sheet tray to the image forming unit;

a reversal unit that reverses a side facing direction of the sheet for the image forming unit;

a second conveying unit that conveys the reversed sheet to the image forming unit;

a discharging unit that discharges the sheet;

a processor configured to control the image forming apparatus and carry out each of the following modes:

a single-sided image forming mode that conveys the sheet from the sheet tray to the image forming unit through the first conveying unit, with the sheet being contained in the sheet tray in such a manner that a first side of the sheet faces toward a predetermined direction, forms an image on the first side of the sheet, and discharges the sheet to the discharging unit in a predetermined discharge state;

a first double-sided image forming mode that conveys the sheet from the sheet tray to the image forming unit through the first conveying unit, forms an image of an even page on a first side of the sheet, reverses the sheet on which the even page is formed using the reversal unit, conveys the reversed sheet to the image forming unit through the second conveying unit, forms an image of an odd page on a second side of the sheet, and discharges the sheet to the discharging unit in a predetermined discharge state; and a second double-sided image forming mode that forms an image of an even page on the second side of the sheet contained in the sheet tray and an image of an odd page on the first side of the sheet, and discharges the sheet to the discharging unit in a predetermined discharge state, wherein the second double-sided image forming mode comprises:

a third forming control unit that conveys the sheet from the sheet tray to the image forming unit through the first conveying unit from the sheet tray, and forms the image of the odd page on the first side of the sheet;

a third reversal control unit that reverses the sheet on which the odd page is formed by the third forming control unit using the reversal unit;

a fourth forming control unit that conveys the reversed sheet from the third reversal control unit to the image forming unit through the second conveying unit, and forms the image of the even page on the second side of the sheet;

a fourth reversal control unit that reverses the sheet on which the even page is formed by the fourth forming control unit using the reversal unit; and a second discharge control unit that discharges the reversed sheet from the fourth reversal control unit to the discharging unit in the predetermined discharge state, wherein the reversal unit includes two reversal mechanisms which are driven separately, wherein the third reversal control unit reverses the sheet using one of the two reversal mechanisms, wherein the fourth reversal control unit reverses the sheet using the other of the two reversal mechanisms, and wherein the second discharge control unit discharges the reversed sheet from the fourth reversal control unit to the discharging unit without passing through the second conveying unit and the image forming unit.

6. The image forming apparatus according to claim 1, further comprising:

a setting unit that sets operation of either the first double-sided image forming mode or the second double-sided image forming mode.

7. The image forming apparatus according to claim 1, wherein the first side includes a image printed side, and wherein the second side includes a image printedless side.

8. The image forming apparatus according to claim 7, wherein the image printed side is a watermarked side, and wherein the image printedless side is a watermarkedless side.

9. The image forming apparatus according to claim 1, wherein the first side includes a glossy side, and wherein the second side includes a glossless side.

10. An image forming apparatus comprising:

a sheet tray configured to contain a sheet;

an image forming unit configured to form a first image and a second image on a first side and a second side of the sheet, respectively;

a first conveying unit that conveys the sheet contained in the sheet tray to the image forming unit;

a discharging unit that includes a first pair of rollers, the discharging unit being configured to discharge the sheet from the image forming apparatus by rotating the first pair of rollers in a forward direction when a gate is in a first position and to reverse the sheet from the first side to the second side or from the second side to the first side by rotating the rollers in a reverse direction before the sheet is discharged from the image forming apparatus;

a second conveying unit that conveys the reversed sheet from the discharging unit to the image forming unit;

a reversal unit that includes a second pair of rollers and the gate, the reversal unit being configured to reverse the sheet from the second side to the first side or from the first side to the second side by rotating the second pair of rollers in a forward direction and moving the gate from the first position to a second position before rotating the second pair of rollers in a reverse direction and moving the gate from the second position to a third position;

a reversal control unit that controls the discharging unit and the reversal unit to perform a first and second reversal for double-sided print;

a first image forming control unit that controls the image forming unit to form the first or second image on the second side of the sheet after the discharging unit performs the first reversal to reverse the sheet from the first side to the second side and the sheet is conveyed to the image forming unit through the second conveying unit;

a second image forming control unit that controls the image forming unit to form the second or first image on the first side of the sheet when the sheet is conveyed to the image forming unit through the first conveying unit from the sheet tray or after the reversal unit performs the second reversal to reverse the sheet from the second side to the first side and the sheet is conveyed to the image forming unit through the second conveying unit; and a discharge control unit that controls the discharging unit to discharge the sheet from the image forming apparatus under conditions of the control by the first image forming control unit, the control by the second image forming control unit, and the second reversal through the reversal unit by the reversal control unit.

11. A driver program product embodied on a computer readable medium which, when executed by a computer connected to an image forming apparatus, enables the computer to control the image forming apparatus to perform predetermined operations, the predetermined operations comprising:

conveying the sheet contained in a sheet tray to an image forming unit;

forming a first image on a first side of the sheet;

reversing the sheet from the first side to a second side by rotating a first pair of rollers in a forward direction with a gate in a first position before rotating the first pair of rollers in a reverse direction;

forming a second image on the second side of the sheet;

reversing the sheet from the second side to the first side by rotating a second pair of rollers in a forward direction and moving the gate from the first position to a second position before rotating the second pair of rollers in a reverse direction and moving the gate from the second position to a third position; and discharging the sheet from the image forming apparatus by rotating the first pair of rollers in the forward direction and moving the gate from the third position to the first position.

12. A method for double-sided printing, the method comprising the steps of:

conveying a sheet from a tray of an image forming apparatus;

reversing the sheet from a second side to a first side by rotating a first pair of rollers in a forward direction and with a gate in a first position before rotating the first pair of rollers in a reverse direction, the sheet not yet having an image formed thereon;

forming a first image on the first side of the sheet;

reversing the sheet from the second side to the first side by rotating a second pair of rollers in a forward direction and moving the gate from the first position to a second position before rotating the second pair of rollers in a reverse direction and moving the gate from the second position to a third position;

forming a second image on the second side of the sheet; and discharging the sheet from the image forming apparatus in a predetermined discharge state by rotating the first pair of rollers in the forward direction and moving the gate from the third position to the first position.

13. The method for double-sided printing according to claim 12, wherein the predetermined discharge state includes a state where the second side of the sheet is directed downward.

14. A method for double-sided printing, the method comprising the steps of:

conveying a sheet from a tray of an image forming apparatus;

forming a first image on a first side of the conveyed sheet;

reversing the sheet from the first side to a second side by rotating a first pair of rollers in a forward direction with a gate in a first position before rotating the first rollers in a reverse direction the sheet;

forming a second image on the second side of the reversed sheet;

reversing the sheet from the second side to the first side by rotating a second pair of rollers in a forward direction and moving the gate from the first position to a second position before rotating the second pair of rollers in a reverse direction and moving the gate from the second position to a third position; and discharging the sheet from the image forming apparatus in a predetermined discharge state by rotating the first pair of rollers in the first direction and moving the gate from the third position to the first position.

15. The method for double-sided printing according to claim 14, wherein the predetermined discharge state includes a state where the first side of the sheet is directed downward.

* * * * *